US011014121B2

(12) United States Patent
Viel et al.

(10) Patent No.: US 11,014,121 B2
(45) Date of Patent: May 25, 2021

(54) SURFACE FUNCTIONALISATION METHOD

(71) Applicant: Commissariat A L'energie Atomique Et Aux Energies Alternatives, Paris (FR)

(72) Inventors: Pascal Viel, Meudon (FR); Thomas Berthelot, Les Ulis (FR); Xavier Lefevre, Lausanne (CH); Jérôme Polesel Maris, Vallieres (FR)

(73) Assignee: Commissariat A L'Energie Atomique Et Aux Energies Alternatives, Paris (FR)

( * ) Notice: Subject to any disclaimer, the term of this patent is extended or adjusted under 35 U.S.C. 154(b) by 313 days.

(21) Appl. No.: 15/301,528

(22) PCT Filed: Apr. 3, 2015

(86) PCT No.: PCT/IB2015/052462
§ 371 (c)(1),
(2) Date: Nov. 3, 2016

(87) PCT Pub. No.: WO2015/151070
PCT Pub. Date: Oct. 8, 2015

(65) Prior Publication Data

US 2017/0113249 A1 Apr. 27, 2017

(30) Foreign Application Priority Data

Apr. 3, 2014 (FR) ..... 1452978

(51) Int. Cl.

| | |
|---|---|
| ***B05D 7/24*** | (2006.01) |
| ***B05D 3/02*** | (2006.01) |
| ***B05D 3/06*** | (2006.01) |
| ***B05D 3/10*** | (2006.01) |
| ***C23C 18/20*** | (2006.01) |
| ***C23C 18/18*** | (2006.01) |
| ***B05D 1/18*** | (2006.01) |
| ***B05D 7/02*** | (2006.01) |
| ***B05D 3/12*** | (2006.01) |
| *C23C 18/36* | (2006.01) |
| *C23C 18/38* | (2006.01) |
| *C23C 18/16* | (2006.01) |
| *C23C 18/40* | (2006.01) |
| *C23C 18/30* | (2006.01) |

(52) U.S. Cl.

CPC ..... *B05D 7/24* (2013.01); *B05D 1/18* (2013.01); *B05D 3/0254* (2013.01); *B05D 3/064* (2013.01); *B05D 3/108* (2013.01); *B05D 3/12* (2013.01); *B05D 7/02* (2013.01); *C23C 18/1889* (2013.01); *C23C 18/1893* (2013.01); *C23C 18/208* (2013.01); *C23C 18/2086* (2013.01); *B05D 3/067* (2013.01); *B05D 3/101* (2013.01); *B05D 2201/00* (2013.01); *B05D 2203/00* (2013.01); *C23C 18/1658* (2013.01); *C23C 18/1831* (2013.01); *C23C 18/2066* (2013.01); *C23C 18/30* (2013.01); *C23C 18/36* (2013.01); *C23C 18/38* (2013.01); *C23C 18/40* (2013.01)

(58) Field of Classification Search

CPC ..... B05D 3/0254

See application file for complete search history.

(56) References Cited

U.S. PATENT DOCUMENTS

| | | | | |
|---|---|---|---|---|
| 3,900,672 | A * | 8/1975 | Hammond | C08L 2666/28 428/334 |
| 3,998,602 | A | 12/1976 | Horowitz et al. | |
| 4,160,756 | A | 7/1979 | Nishida et al. | |
| 6,033,492 | A | 3/2000 | Honda et al. | |
| 6,211,283 | B1 * | 4/2001 | Honda | B05D 7/142 524/501 |
| 2004/0039074 | A1 * | 2/2004 | Hahnle | C08J 9/36 521/134 |
| 2005/0233183 | A1 * | 10/2005 | Hampden-Smith | B01J 21/18 429/492 |
| 2007/0212883 | A1 * | 9/2007 | Kano | C08J 7/045 438/694 |
| 2008/0145706 | A1 | 6/2008 | Mevellec et al. | |
| 2009/0269606 | A1 | 10/2009 | Matsumoto | |
| 2009/0286308 | A1 | 11/2009 | Berthelot et al. | |
| 2011/0183125 | A1 * | 7/2011 | Aoki | C09D 11/322 428/195.1 |

(Continued)

FOREIGN PATENT DOCUMENTS

| | | |
|---|---|---|
| CA | 2 102 240 | 10/1992 |
| DE | 10 2011 076148 | 11/2012 |

(Continued)

OTHER PUBLICATIONS

Ding et al. (Layer-by-layer structured films of TiO2 nanoparticles and poly(acrylic acid) on electrospun nanofibers; Nanotechnology, 15, 2004, 913-917 (Year: 2004).*

Eisenberg et al., Dehydration Kinetics and Tg of poly(acrylic acid), J. Polym. Sci., vol. 7, pp. 1717-1728, 1969 (Year: 1969).*

Holman et al., Surface Adsorption Effects in the Inkjet Printing of an Aqueous Polymer Solution on a Porous Oxide Ceramic Substrate, Journal of Colloid and Interface Science, 247, 266-274 (2002) pp. 266-274 (Year: 2002).*

Park, et al., Effect of Drying Conditions on the Glass Transition of Poly( Acrylic Acid), Polymer Engineering and Science, 31, 12, (1991), pp. 867-872 (Year: 1991).*

(Continued)

*Primary Examiner* — Francisco W Tschen

(74) *Attorney, Agent, or Firm* — Alston & Bird LLP

(57) ABSTRACT

The invention relates to a method for functionalising a surface of a solid substrate with at least one acrylic acid polymer layer, said method including the steps of: i) placing the surface in contact with a solution having of at least one acrylic acid homopolymer, a solvent and, optionally, metal salts; ii) removing the solvent from the solution in contact with the surface; and iii) binding the polymer to the surface by thermal treatment.

9 Claims, 10 Drawing Sheets

(56) References Cited

U.S. PATENT DOCUMENTS

| | | | | |
|---|---|---|---|---|
| 2011/0281032 | A1* | 11/2011 | Kagata | C09D 11/322 427/256 |
| 2012/0276394 | A1* | 11/2012 | Yamamoto | B05D 7/02 428/447 |
| 2014/0370198 | A1* | 12/2014 | Navarro | C08F 293/005 427/340 |

FOREIGN PATENT DOCUMENTS

| | | | |
|---|---|---|---|
| EP | 2 121 814 | | 11/2009 |
| GB | 2169925 | A | 7/1986 |
| WO | WO 97/04880 | | 2/1997 |
| WO | WO 98/44172 | | 10/1998 |
| WO | WO-2006/075796 | A1 | 7/2006 |
| WO | WO 2007/048894 | | 5/2007 |
| WO | WO 2009/121944 | | 10/2009 |
| WO | WO 2010/125189 | | 11/2010 |
| WO | WO 2012/126943 | | 9/2012 |
| WO | WO 2012/172066 | | 12/2012 |
| WO | WO-2013083919 | A1 * | 6/2013 ..... C08F 293/005 |

OTHER PUBLICATIONS

Chem. Rev., 2005, 105 (4) pp. 1103-1170.
ChemPhysChem, 2004, 5, 1469-1481.
Mevellec et al., Chem. Mater., 2007, 19, 6323-6330.
Silanes and Other Coupling Agents, vol. 4, K. L. Mittal, CRC Press, 2007.
U. Lohbauer, Materials, 2010, 3, 76-96.
International Search Report and Written Opinion for corresponding International Application No. PCT/IB2015/052462, dated Sep. 25, 2015.

* cited by examiner

SURFACE FUNCTIONALISATION METHOD

FIELD

The present invention relates to a process for the functionalization of a surface of a solid organic or inorganic support with at least one layer of a polymer based on acrylic acid, to the substrates capable of being obtained by this process and to their use in the preparation of implantable medical devices, in the preparation of biosensor surfaces, in structural adhesive bonding, in the manufacture of composite materials, in printed electronics, in the complete or localized metallization of glass or plastic surfaces, in the preparation of hydrophilic or hydrophobic glazings or in the treatment of the heavy metals of liquid effluents.

BACKGROUND

The grafting of polymer films to different types of surfaces (metal, glass, plastic, and the like) has aroused great interest in numerous fields of application in recent years. This is because the surface modification of materials has a crucial importance insofar as the majority of their properties are expressed via the phase located at the connection between the substrate and the external environment. By way of example, the adhesive, wettability, corrosion protection and biocompatibilization properties require firm control of the surface modifications.

Currently, there exists several processes which make possible the immobilization of thin organic films of the surface of a solid support. These are generally specific and are based on a favored interaction between a molecule and a substrate.

Thus, the grafting of thiols to a gold surface is based on the favored chemical interaction of the sulfur atoms with a gold surface. This process makes it possible to manufacture self-organized organic monolayers [*Chem. Rev.,* 2005, 105 (4), pp. 1103-1170]. The process is generally reserved for fundamental studies and is not of high stability as the thiol layer can desorb. It does not strictly concern covalent interfacial bonds.

Likewise, the grafting of a silane layer to glass or oxide is based on the favored interaction of the silicon atoms with the oxygen atoms. This process is widely used in microelectronics [Silanes and Other Coupling Agents, Volume 4, K. L. Mittal, CRC Press, 2007]. Covalent siloxane bonds can under some conditions be created but they will remain sensitive to hydrolysis.

Furthermore, cathodic electrografting makes it possible to create a true covalent bond between the organic layer and the substrate. Marked out in particular is the electrografting of vinyl monomers [ChemPhysChem, 2004, 5, 1469-1481], the electrografting of diazonium salts [WO1998044172], or the electrografting of a mixture of vinyl monomers and diazonium salts [WO 2007/048894]. However, these processes require the use of a substrate which is a conductor or semiconductor of electricity.

The Graftfast® process is a process for the surface coating of conducting, semiconducting and insulating substrates with a thin layer of organic polymer via the redox activation of aryldiazonium salts in the presence of vinyl monomers in an acidic aqueous medium (Mévellec et al., Chem. Mater., 2007, 19, 6323-6330; EP 2 121 814 B1). Typically, according to this process, the aryldiazonium salts are reduced with an iron powder to form aryl radicals which are reactive with regard to the surface, resulting (i) in the formation of films of polyphenylene type at the surface of the substrate and (ii) in the initiation of the polymerization of the vinyl monomer in solution. The macromolecular chains terminated by a radical which are formed in solution are subsequently capable of reacting with the polyphenylene-based primary layer to form a very thin and homogeneous organic film at the surface.

Several alternative forms of this process have been described in the state of the art, in particular in international applications WO 2009/121944, WO 2012/172066, WO 2010/125189 and WO 2012/126943.

In all the cases, these processes require a stage in which the surface of the solid support is brought into contact with at least one solvent and one cleavable aryl salt, in particular an aryldiazonium salt, followed by a state of reduction of these salts under nonelectrochemical conditions, making possible the formation of radical entities from the cleavable aryl salt. This reduction, generally carried out in the presence of iron filings, furthermore requires an additional stage of separation of the reducing agent. Finally, this process, which makes it possible to graft films to supports of varied natures, does not make it possible to obtain effective functionalization of surfaces made of glass or on stainless steels.

SUMMARY

It has now been discovered that it is possible to immobilize an acrylic acid polymer directly at the surface of a solid support by simple thermal or radiative treatment, without it being necessary to functionalize the surface of the support beforehand with an adhesion primer, in particular via cleavable aryl salts, in particular aryldiazonium salts. The polymer layer immobilized at the surface of the solid support constitutes in itself an adhesion layer capable of reacting with other molecules present in its environment via the carboxylic acid and/or anhydride functional groups of the polymer based on acrylic acid.

This process offers several advantages with respect to the functionalization processes known in the state of the art, in particular with respect to the Graftfast® process. First, insofar as it is not necessary to functionalize the surface of the material beforehand with cleavable aryl salts, it requires fewer stages and is thus simpler to carry out, more economical and more ecological. Furthermore, the acrylic acid polymer is a biocompatible polymer, which renders it particularly suitable for the functionalization of supports intended for a biological or medical application. In addition, this process makes it possible to very easily control the thickness of the adhesion layer based on acrylic acid polymer, either through the mass concentration of the polymer based on acrylic acid in the solvent, or by taking advantage of the polyelectrolytic properties of the acrylic acid polymer, which allow it to be strongly adsorbed on substrates which exhibit surface electrostatic charges (such as, for example, oxides, metals or materials which have undergone a surface oxidation). Under these conditions, it is then possible to obtain, reproducibly and conformably (i.e., the layer perfectly follows the topography of the surface of the material), a residual thin layer (in particular a thickness of <20 nm) of acrylic acid polymer. This property is particularly advantageous when it is a matter of coating substrates having complex geometries, for example substrates exhibiting a spherical geometry, or sharp edges, such as cubic or parallelepipedal geometries, or also exhibiting a high form factor: this is the case in particular of the substrates exhibiting a deep groove or hole, the opening diameter of which is narrow, such as vias in microelectronics. In particular, the conforming nature of the layer of polymer based on acrylic acid, which polymer is obtained by this process, makes it possible to obtain, during the subsequent metallization of the substrate, a metal coating of very good optical quality ("mirror finish" appearance).

The process of the invention also advantageously makes it possible to modulate the swelling of the adhesion layer via in particular the crosslinking of the polymer based on acrylic acid during the thermal or radiative treatment. Finally, this process makes it possible to functionalize solid organic or inorganic supports of varied natures, in particular glass and stainless steel, or else polymers supposed to be very difficult to modify, such as, for example, polytetrafluoroethylene (PTFE), the metallization of which according to the process of the invention presents major advantages in the field of high frequency electronics.

Thus, according to a first aspect, a subject matter of the invention is a process for functionalizing a surface of a solid support with at least one layer of polymer based on acrylic acid, said process comprising the stages of:

i) bringing said surface into contact with a solution comprising:

a polymer based on acrylic acid;

a solvent;

said solution not comprising an adhesion primer based on cleavable aryl salts, in particular aryldiazonium salts;

ii) removing the solvent from the solution in contact with said surface; and iii) fixing the polymer to said surface by heat or radiative treatment.

Stage i)

The solid support employed in stage i) can be an organic or inorganic support, in particular a conducting, semiconducting or insulating organic or inorganic support. It can be chosen in particular from metals, such as copper, nickel, stainless steel, aluminum, iron or titanium, or their oxides, such as titanium dioxide ($TiO_2$), iron oxides or aluminum oxides; inorganic oxides, in particular those based on silicon oxide, commonly known as glasses; plastics; cellulose papers; synthetic papers, such as Teslin®, carbon fibers, in particular woven or nonwoven carbon fibers; and composite materials, such as epoxy resins reinforced with glass fibers, carbon fibers or natural fibers.

According to one embodiment, the process comprises a stage o), prior to stage i), which consists in subjecting the solid support to a surface pretreatment of oxidative type, in particular chemical and/or radiative oxidative type, so as to increase the affinity of the solid support with the solution containing the polymer based on acrylic acid. This treatment can comprise a stage of exposure to an oxygen or argon plasma, to UV ozone activation or chemical oxidation with acids.

According to another embodiment, the process comprises a stage o'), prior to stage i), which consists of subjecting the solid support to a surface pretreatment of oxidative type, followed by a deposition of a thin film (in particular with a thickness <5 nm) of a cationic polymer, typically polyethyleneimine (PEI) or polyallylamine, so as to increase the affinity of the solid support with the solution containing the polymer based on acrylic acid, by development of the electrostatic interactions. This specific embodiment is typically carried out with substrates having a high form factor or substrates of oxide type.

Within the meaning of the present description, the term "polymer based on acrylic acid" is understood to mean a polymer comprising the following repeat unit: $—(CH_2—CX(COOH))_n—$, where X is H, or a $C_1$-$C_6$ alkyl group, in particular a $CH_3$ or $C_2H_5$ group. Preferably, X is H. It may concern a homopolymer or a copolymer of acrylic acid, the latter predominantly comprising acrylic acid (X=H) monomers, in particular more than 60% by weight, in particular more than 75% by weight, with respect to the total molecular weight of the copolymer. Mention may be made, as example of copolymer, of the copolymer of acrylic acid and maleic acid. The molecular weight of the polymer based on polyacrylic acid can vary to a large extent, in particular from 2 000 $g \cdot mol^{-1}$ to 1 000 000 $g \cdot mol^{-1}$. Preferably, the molecular weight of the polymer based on polyacrylic acid is between 50 000 $g \cdot mol^{-1}$ and 300 000 $g \cdot mol^{-1}$.

Preferably, the polymer is an acrylic acid homopolymer, also denoted PAA hereinafter, in particular having a molecular weight of 130 000 $g \cdot mol^{-1}$. The solution employed in stage i) can additionally comprise a second or several acrylic acid homopolymers having a different molecular weight.

The solvent can be chosen from water, alcohols or a mixture of these. The alcohols can in particular be chosen from $C_1$-$C_6$ alcohols, in particular ethanol. According to one alternative form, the solvent is an aqueous/alcoholic mixture, in particular water/ethanol mixture. The water/alcohol fraction can vary to a large extent, in particular as a function of the surface energies of the materials to be functionalized.

The solution employed in stage i) can additionally comprise a second polymer based on acrylic acid of a different nature from the first. This solution can also comprise adjuvants, such as wetting agents, viscosity reducers, emulsifiers or pigments, complexing agents or fluorophores. It can also comprise crosslinking agents, such as polyallylamine hydrochloride, hexamethylenediamine hydrochloride, polyethylene glycol or polyethylene glycol diamine.

The solution employed in stage i) does not comprise an adhesion primer based on cleavable aryl salts, in particular aryldiazonium salts. According to an embodiment, the solution employed in stage i) does not comprise an adhesion primer other than the polymer based on acrylic acid.

Within the meaning of the present description, the term "adhesion primer" is understood to mean any organic molecule capable, under certain conditions, of adhering to, in particular of being chemisorbed at, the surface of a solid support, in particular by radical reaction, such as a radical chemical grafting. Such molecules comprise at least one functional group capable of forming a radical. Examples of adhesive primers include in particular cleavable aryl salts, such as aryldiazonium salts. The term "cleavable aryl salts" is understood to mean, within the meaning of the present description, aryl salts ($ArX^{n+}Y^{n-}$) capable of generating an aryl radical (Ar.), in particular by homolytic cleavage of the Ar—X bond. Examples of cleavable aryl salts are in particular aryldiazonium salts, arylammonium salts, arylphosphonium salts, aryliodonium salts and arylsulfonium salts. These molecules are thus capable of forming a crosslinked film and adhere to the surface of the solid support via these radical reactions.

The solution can be applied to the surface of the solid support according to different methods, in particular by dipping (immersion-emersion) centrifuging (spin coater), sprinkling (spray), projection (ink jet, pistol spraying) or by transfer (brush, felt brush, pad).

The thickness of the layer of polymer based on acrylic acid obtained in stage iii) can be easily adjusted via the concentration of the polymer based on acrylic acid in the solution of stage i) and/or via the successive deposition of layers of polymers based on acrylic acid on the surface of the support, that is to say via the repetition of stages i) to iii), stage iii) being optional between two successive depositions.

By way of example, on a flat surface, typically a glass strip or a mirror finish metal surface, a 2% by weight concentration of PAA in ethanol makes it possible to obtain a PAA layer with a thickness of 1000 nm, a concentration of the order of 0.5% by weight of PAA in ethanol a thickness of 70 nm and a concentration of the order of 0.2% by weight of PAA in ethanol a thickness of 17 nm.

Stage ii)

Stage ii) consists of the removal of the solvent from the solution of stage i) deposited at the surface of the solid support, generally in the form of a homogeneous film.

The solvent can be removed by any appropriate technique well known to a person skilled in the art, such as simple drying in the air, in particular for the solutions based on alcoholic solvents, for example with ethanol, or evaporation under reduced pressure, in particular for the solutions based on aqueous/alcoholic solvents.

According to one embodiment, the process additionally comprises two stages subsequent to stage ii) of:

$ii_1$) rinsing with water the surface of the solid support obtained in stage ii); and $ii_2$) drying said surface.

Stage $ii_1$) makes it possible to remove the polymer based on polyacrylic acid not specifically and/or chemically adsorbed at the surface of the solid support on the conclusion of stages i) and ii). This stage can comprise several successive rinsing operations with water until a conforming layer, that is to say a residual layer of polymer, of unvarying thickness, is obtained at the surface of the solid support.

Thus, stages $ii_1$) and $ii_2$) advantageously make it possible to control the thickness of the layer of polymer based on acrylic acid fixed to the surface of the solid support, in particular to obtain a conforming and reproducible thin residual layer (thickness of less than 20 nm), by removing, by rinsing with water, the parts not specifically adsorbed on the surface on conclusion of stage ii). This is because the polymer based on acrylic acid behaves as a polyelectrolyte which can be adsorbed by electrostatic interactions on certain surfaces, such as oxides, metals or else materials which have been subjected to a prior surface oxidation (chemical and/or radiative), thus creating electrostatic charges favorable to the expression of the adsorption phenomena. These electrostatic interactions are exerted over a distance which is dependent on the nature of the polymer and of the substrate. The balance of these different forces results in the deposition of a thin layer with a thickness perfectly defined after several successive rinsing operations. It is with regard to interactions of this type that LBL (Layer By Layer) deposits are manufactured, for example. Thus, when several successive rinsing operations with water are carried out after stage ii), the "residual" thickness of the layer of polymer based on acrylic acid no longer varies and the conformity of this layer with respect to the surface becomes excellent. In addition, due to its very principle of manufacture, it is thus possible to obtain a conformity of the deposit even on complex structures or structures exhibiting a high form factor.

Stage iii)

Stage iii) is a stage which makes possible the fixing of the polymer based on acrylic acid to the surface of the solid support by heat or radiative treatment of the surface obtained in stage ii). The term "fixing" is understood in particular to mean a covalent or noncovalent grafting, in particular via polyelectrolytic interactions, of the polymer to the surface of the solid support. During this stage, the deposit obtained in stage ii) is subjected to a heat or radiative treatment, via in particular light or electron irradiation, in order to render it adherent to the surface. This is because this treatment creates chemical hardening mechanisms, via in particular the homocrosslinking of the polymer based on acrylic acid, which render the polymer layer insoluble, difficult to dissolve and mechanically difficult to tear off.

Surprisingly, this process makes it possible to obtain an adhesion of the layer of polymer based on acrylic acid on materials of any type. This adhesion would result from different physiochemical phenomena which can vary according to the nature of the support and/or the nature of the treatment in stage iii), that is to say heat or radiative treatment.

Thus, without wishing to be restricted to a specific theory, the heat or radiative treatment would make it possible in particular to generate reactive radical entities which will confer cohesive properties, due to the crosslinking between the polymer chains with one another, and/or adhesive properties, due to the reaction of the radical entities with the solid support.

By way of example, the adhesion of the layer of polymer based on acrylic acid to solid supports, such as plastics, metals or glass, might result from a covalent grafting via the thermal decarboxylation of the polymer based on acrylic acid. On glass, the adhesion might result from a polyelectrolytic adhesion, that is to say from the interaction between the calcium or aluminum ions of the glass and the carboxylic functional groups of the polymer based on acrylic acid via the formation of salt bridges (U. Lohbauer, Materials, 2010, 3, 76-96).

In the absence of covalent bonds between the solid support and the layer of polymer based on acrylic acid, it is assumed that the adhesion and consequently the adherence of the polymer based on acrylic acid results from several factors or from a combination of these, including in particular the viscoelastic dissipation abilities of the polymer, the polyelectrolyte nature of the latter and/or the crosslinking induced by a heat or radiative treatment via the decarboxylation of the anhydride functional groups.

Heat Treatment

According to one embodiment of the invention, stage (iii) is carried out by heat treatment, in particular at a temperature of between 150° C. and 300° C., more particularly at a temperature of approximately 200° C.

Typically, this treatment is carried out on materials which can withstand such temperatures, for a period of time which can range up to 60 minutes, typically from 2 to 30 minutes.

The heat treatment can in particular be applied to supports such as metals (stainless steel, aluminum, copper, titanium), glasses, silicon and some heat-stable polymers, such as polyimide or polytetrafluoroethylene.

This treatment results in a dehydration by condensation of the carboxylic acid functional groups of the polymer based on acrylic acid and thus in the formation of anhydride functional groups.

The latter in their turn undergo, within the temperature range applied, a decarboxylation resulting in the formation of radicals capable of coupling together intermolecularly and/or of reacting with the surface when they are formed close to it (cf: schemes below).

Scheme 1: Chemical mechanism which may justify the cohesion of the film
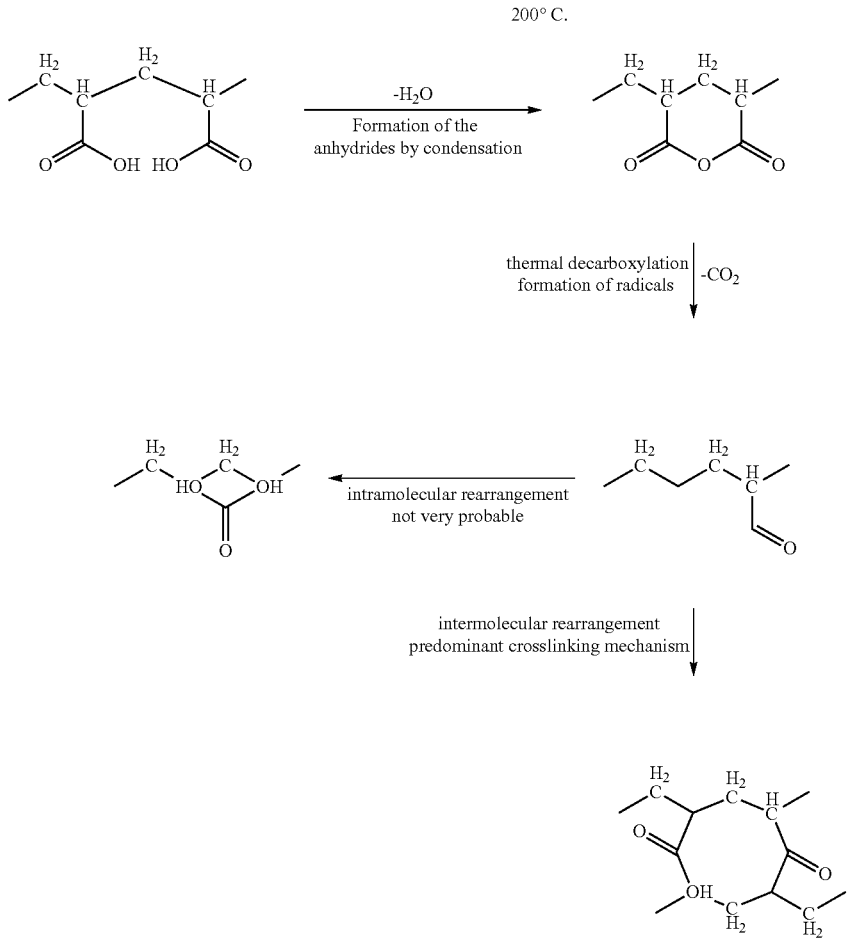
Scheme 2: Chemical mechanism which may justify the adhesion of the film
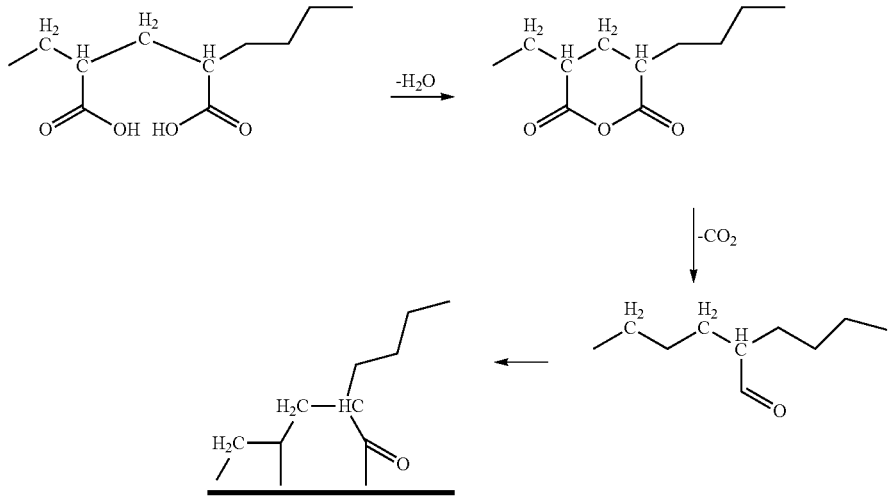

Scheme 3: Schematic diagram of the grafting by heat treatment

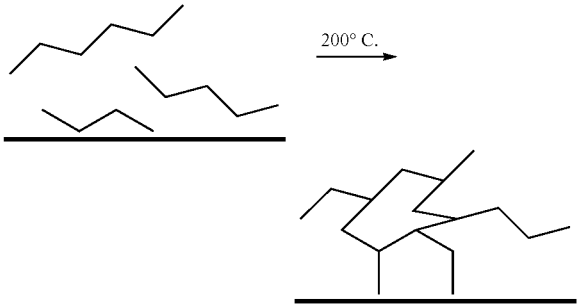

The radicals created by decarboxylation at 200° C. will confer on the film cohesive properties (interchain crosslinking coupling) and adhesive properties (reaction of radicals with the substrate).

In addition, at the end of the treatment, the polymer layer exhibits a very high concentration of residual anhydride groups which can be involved spontaneously in chemical reactions, for example and without limitation with amine, alcohol, acid or thiol functional groups.

These anhydride functional groups can also be hydrolyzed in the basic medium to generate carboxylate functional groups, which can subsequently be acidified to give carboxylic acid functional groups, also capable of reacting according to customary chemical coupling processes. Thus, the acidic or basic chemical forms of PAA can easily be restored by simple control of the pH of the solution in which the film is immersed. The pKa of the immobilized film on departing from the solution after drying lies between 5 and 6, i.e. at a value greater than that of acrylic acid (pKa=4.2), as a result of the confinement of the material. It is thus possible to observe the two components (carboxylate and carboxyl functional groups) simultaneously at this pH. The acid/base conversion is generally rapid. If the PAA film is put back into its acidic form, it is possible to restart a complete conversion cycle: acid-anhydride-carboxylate-acid, and so on.

Finally, the annealed film retains its swelling nature with regard to solvents, in particular aqueous solvents, a property essential for certain applications, such as metallization, for example.

Radiative Treatment

According to another embodiment, stage iii) is carried out by radiative treatment.

This treatment consists in subjecting the polymer to ultraviolet radiation (Vacuum UV, or VUV), that is to say to a wavelength of between 100 and 200 nm. It is particularly suitable for flat surfaces or surfaces with a shape which makes possible exposure to light, in particular for solid supports chosen from gold layers, polyvinyl chloride (PVC), polyethylene terephthalate (PET), polyvinylidene fluoride (PVDF), and polytetrafluoroethylene (PTFE).

The radiative route advantageously makes it possible to immobilize thin films of polymer based on acrylic acid on thermally unstable substrates.

By way of example, the 172 nm radiation from the excimer lamp of the Osram brand of Xeradex® type makes it possible to break the bonds of the polymer based on acrylic acid and to create excited entities, in particular radicals and/or ions. Scheme 4 makes it possible to realize that, at 172 nm, numerous chemical bonds of the polymers can absorb light and be excited.

The radicals are notably capable of recombining by interchain mechanisms which make it possible to crosslink the film in its body but also of recombining with the surface when they are formed nearby. When the substrate is itself organic (such as PVC, PET, PVDF, PTFE) and attacked by the radiation, it can in the same way be excited and recombine with the polymer which covers it. The radiative treatment thus makes it possible to confer cohesive properties (crosslinking) and adhesive properties (surface grafting). (cf. scheme 5 below).

Scheme 5

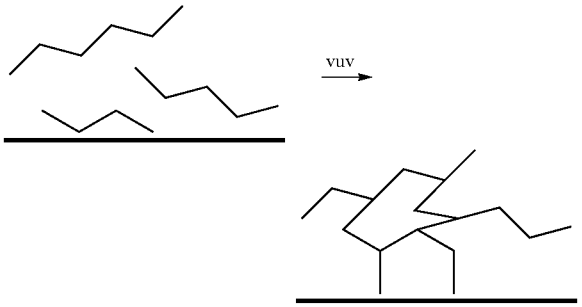

The radicals created by exposure to VUV radiation will confer on the film cohesive properties (interchain crosslinking coupling) and adhesive properties (reaction of radicals with the substrate).

The adhesion of the layer of polymer based on acrylic acid to the surface implies that the radiation is reaching as far as the film-substrate interface. The thickness of the layer can thus be adjusted according to the rules of decrease in absorption of the radiation, of the duration and/or of the irradiation power. Typically, films of 1 to 150 nm can be immobilized with irradiation times of between 2 and 15 minutes for an irradiation power of the order of 140 W.

At the end of the treatment, the polymer layer still exhibits a very high concentration of carboxyl groups which can be involved spontaneously in chemical reactions, for example and nonlimitingly with amine, alcohol, acid or thiol functional groups.

The irradiated film retains its swelling nature with regard to solvents, in particular aqueous solvents, an essential property in certain applications, such as metallization, for example.

The anhydride and/or carboxylic acid functional groups thus advantageously make it possible to graft advantageous molecules or materials to the surface of the polymer layer via their covalent coupling with other chemical functional groups, the layer of polymer based on acrylic acid thus acting as "adhesion primer".

Thus, according to an alternative form, the process according to the invention comprises a stage, subsequent to stage iii), of covalent grafting of advantageous molecules to the polymer layer obtained, in particular a biological molecule or a resin, that is to say a natural or synthetic, in particular thermoplastic or thermosetting, polymer, more particularly two-component resins. Two-component resins are resins obtained from two components: the resin, on the one hand, which can be a first monomer or a prepolymer, and the hardener, on the other hand, which can be a second monomer or prepolymer, also known as crosslinking agent. Mention may be made, as examples of two-component resins, of the resins listed in the table below.

| Family of two-component resins | First monomer or prepolymer | Second monomer or prepolymer or crosslinking agent |
|---|---|---|
| Aminoplasts: urea/formaldehyde resins (UF) | Formaldehyde | Monomer carrying amino-NH2 groups: urea |
| Aminoplasts: melamine/formaldehyde resins (MF) | Formaldehyde | Monomer carrying amino —NH2 groups: melamine and sometimes thiocarbamide, hydrogen cyanamide or dicyandiamide |
| Phenoplasts or phenol/formaldehyde resins (PF) | Formaldehyde | Phenol |
| Polyepoxides or epoxides and even epoxies (EP) | Epoxide monomers or prepolymers | Crosslinking agent (sometimes known as hardener): acid anhydride, phenol or most generally an amine |
| Polybismaleimides (BMI): thermosetting polyimides (PIRP) | Acid di- and/or polyanhydride | Di- and/or polyamine |
| Crosslinked polyurethanes (PUR) | Di- and/or polyols | Di- and/or polyisocyanates |

By way of example, the biological molecule can be grafted by a bioconjugation reaction between the carboxylic acid groups of the surface (obtained after VUV treatment or after hydrolysis of the anhydride functional groups) and the amine functional groups of the proteins, as is conventionally done with peptide couplings employing a combination of activating agents, such as N-hydroxysuccinimide and N,N'-digclohexylcarbodiimide (NHS/DCC) in an organic medium or sulfo-N-hydroxysuccinimide and ethyl-3-(3-dimethylaminopropyl)carbodiimide hydrochloride (sulfo-NHS/EDC) in an aqueous medium.

According to another embodiment, the covalent grafting stage subsequent to stage iii) comprises:

a) the activation of the carboxylic acid functional groups with an activating agent, resulting in the formation of activated carboxylic ester functional groups and/or of carboxylic acid anhydride functional groups; and b) the reaction of the activated ester and/or carboxylic acid anhydride functional groups with advantageous molecules, in particular with biological molecules and/or two-component resins.

Thus, in an aqueous medium concentrated in carboxylic acid functional groups, the activated esters formed react with the neighboring acid groups to reform, this time by the chemical route, anhydride functional groups, this being the case even at ambient temperature. Advantageously, this embodiment makes it possible to obtain a coating exhibiting anhydride functional groups without having recourse to the heat treatment. This is particularly advantageous for substrates which are thermally unstable and thus incapable of withstanding the treatment at a temperature of between 150° C. and 300° C. required in order to directly obtain the anhydride functional groups.

The anhydride functional groups, obtained directly by the thermal route or subsequently by the chemical route subsequent to the activation with coupling agents as described above, can be spontaneously directly coupled with resins, in particular two-component resins: by way of example with the amino groups of two-component resins of epoxy (polyepoxide resins (EP)), polyimide (thermosetting polyimide resins PIRP) and melamine/formol (melamine/formol aminoplast resins (MF)) type or with the alcohol groups of two-component polyurethane resins (crosslinked polyurethane resins (PUR)).

According to another alterative form, the polymer solution in stage i) comprises metal salts.

The process then comprises a stage, subsequent to stage iii), of reduction of the metal salts, whereby a metallization of the surface of the solid support is obtained. For further information relating to the metallization of the solid supports, reference may in particular be made to the international application WO 2012/126943. According to another aspect, a subject matter of the invention is the substrates obtainable by the process as defined above.

The layer of polymer based on acrylic acid immobilized at the surface of the solid support generally has a thickness of between 3 nm and 5000 nm, in particular between 10 nm and 1000 nm, more particularly between 20 nm and 500 nm, in particular between 10 and 100 nm, for example between 20 nm and 70 nm. More particularly for the radiative treatments, the layer of polymer based on acrylic acid immobilized at the surface of the solid support has a thickness of between 3 nm and 300 nm, in particular between 10 nm and 100 nm, for example between 20 nm and 70 nm.

Advantageously, this layer of polymer based on acrylic acid immobilized at the surface of the solid support according to the process described above withstands prolonged washing operations, even in the normal solvents for PAA, such as ordinary water, seawater or else basic solutions (pH=10).

Withstanding prolonged washing operations is understood to mean that the intensity of the infrared absorption signal of the bands characteristic of the immobilized PAA (intensity directly related to the thickness of the PAA layer), in particular of the absorption bands characteristic of the carboxylic acid functional group at 1721 $cm^{-1}$ and carboxylate functional group at 1576 $cm^{-1}$, varies by less than 20%, advantageously by less than 10%, preferably by less than 5%. According to the crosslinking rate obtained subsequent to the heat or radiative treatment, the removal of the non-crosslinked chains is possible (cavities may thus advantageously be formed). It is then important to observe the stabilization of the amount of matter with respect to the washing operations. By way of example, the intensity of the absorption peak of the carboxyl functional group COOH (1721 $cm^{-1}$) of a layer with a thickness of 100 nm of PAA immobilized by the thermal route on a substrate, such as stainless steel, and then hydrolyzed in an aqueous medium will lose 5% of matter in the first washing operation and then remain stable after an immersion in seawater for 72 h. In the same way, the intensity of the absorption peak of the carboxylate $COO^-$ functional group (1576 $cm^{-1}$) of a layer with a thickness of 200 nm of PAA immobilized by the thermal route on a gilded substrate will lose 5% of matter in the first washing operation and then will decrease by barely 3% after immersion in an aqueous solution at pH 10 for 120 h, the thickness of the layer of PAA remaining virtually stable beyond. Thus, a layer with a thickness of 100 nm of PAA immobilized by the thermal route on a substrate of glass type and having been subjected to an immersion in water for 24 h and then to successive rinsing operations with alcohol, acetone and DMF under ultrasound for 15 min further withstands a subsequent immersion in seawater for 48 h, with a decrease in the intensity of the absorption signal of less than 5%.

According to another aspect, a subject matter of the invention is the use of the substrates obtainable according to the process of the invention and/or the use of the process according to the invention in the treatment of liquid effluents by capturing heavy metals, in the preparation of stents, prostheses or implantable medical devices, in the preparation of electrical circuits on glass, plastic, optical resin (of the type of resins based on Cyclo Olefin Polymer (COP), for example) or paper (of Teslin® type, for example), such as RFID antenna circuits, or in the preparation of reflecting surfaces, in the grafting of biological molecules to paper, glass, plastic or metal, in applications in structural adhesive bonding or in the manufacture of composite materials having carbon fiber reinforcement (or Carbon Fiber Reinforced Polymer).

According to another aspect, the invention relates to the use of the process according to the invention to deposit a metallization primer on a substrate by the electroless route, in particular on glass or polymers, in particular composites, such as polymers having carbon fiber or glass fiber reinforcement.

As used here, "metallization by the electroless route" denotes a process for metallization by the chemical route, that is to say without electricity or nonelectrolytic bath, via a process of controlled autocatalytic reduction of the metal ions, resulting in the formation of a uniform metal layer.

As regards the glass, by far the most widely used process industrially for liquid-phase metalizing is that of the silane coupling agents. Silanes are compounds capable at the same time of grafting to the glass and of capturing the catalytic metals of electroless processes. Their disadvantages are, on the one hand, the hydrolysable nature of the layers deposited. This is because the siloxane bond Si—O—Si is very polar and thus very hydrolysable. For example, the leaching of a facade glazing is 1 μm per year, that is to say several nanometers per day. Consequently, with the silane layers, a risk of detachment is observed. On the other hand, the silane solutions used to produce the coatings are not chemically stable over time. The solution is prepared and condensation mechanisms take place. It is thus necessary to continually remake the solutions before application. The process according to the invention advantageously makes it possible to overcome these disadvantages.

The metallization of composite materials, in particular of carbon composites, is of increasing interest in the field of aeronautics.

This is because, in order to allow aircraft to be subjected to lightening without damage to the onboard electronics, the fuselage or wing elements of aircraft are generally formed of electrically conducting materials. The aeronautical industry is increasingly tending to replace these conducting materials with carbon composites, which have an insulating nature and which it is thus necessary to metalize. This metallization is currently carried out by addition of copper fabrics or addition of copper wires to the carbon composites. However, this metallization is very expensive and burdensome to carry out.

Another process consists in projecting metal particles onto the composite material, so as to physically inlay these particles into the material. However, the continuity of the layer and the resulting conduction properties are not satisfactory.

Other processes use chemical treatments which activate and etch polymers, such as ABS or ABS-PC, at the surface in order to carry out an electroless metallization. However, these processes require the use of highly toxic and polluting sulfuric acid/chromic acid (chromium(VI)) solutions and cannot be applied to certain epoxy or polyurethane resins or to carbon composite materials of use in the aeronautical industry.

Advantageously, the metallization process according to the invention makes it possible to metalize such composites, in particular carbon fiber-epoxy resin composites, at reduced costs, at the surface, as continuous and thin layers, in order to render them conductive. In addition, this process is easy to carry out and makes it possible to metallize elements directly on site.

The process is thus of particular use for metalizing the constituents of the frame of an aircraft, in particular the fuselage or the wings, formed of polymer composite materials, in particular having a carbon fiber reinforcement.

The process according to the invention is also particularly of use for metalizing heat-resistant polymers which are difficult to treat at the surface. By way of example, the process makes it possible to metalize kevlar, in particular in the fabric form, for intelligent textile applications, or else polyimide, for printed flexible electronics applications.

The process according to the invention is also of particular use for metalizing semiconducting materials. This is because a recurrent problem in microelectronics is the production of barrier layers to the diffusion of the copper atoms (producing the conducting parts) toward the silicon (semiconducting part) in order to prevent the copper from poisoning the semiconducting properties of the silicon.

By way of example, the metallization of titanium nitride, widely used in microelectronics, is currently carried out via physical vacuum metallization processes which are particularly burdensome and complex to carry out. The process according to the invention makes possible the formation of barrier layers, for example of nickel, having an electrical continuity between the copper, on the one hand, and the titanium nitride, on the other hand.

The process according to the invention is also of use in the preparation of pollution-control coatings, for example in the manufacture of a material for the filtration of liquid effluents contaminated by dissolved metal salts.

Its curing at 200° C., which generates a dehydration reaction in order to form anhydrides (between 120 and 150° C.) and then a decarboxylation of these anhydrides which generates radical entities which are taken advantage of in order, on the one hand, to crosslink the PAA films in its body and, on the other hand, to graft the same PAA film to the substrate where it is deposited. Only a fraction of the anhydride functional groups are decarboxylated.

At the end of the heat treatment, the film is chemically grafted to the substrate and crosslinked. It is in a completely anhydride chemical form for the functional groups which have not undergone decarboxylation.

The PAA film is then treated in a basic aqueous solution in order to rehydrate the anhydrides and to restore the polyacrylic acid form.

This polyacrylic acid chemical form can advantageously efficiently capture metal salts and is thus of particular use for pollution control or metallization applications.

The process is also of use in the preparation of an adhesion reinforcer which is self-bonding via the anhydride functional groups.

The process according to the invention thus makes it possible to deposit, over a broad range of substrates, thin coatings in an anhydride form which is capable of spontaneously and very easily reacting at ambient temperature with two-component paints or resins, such as epoxy or polyurethane paints or resins. The anhydride forms react, for example, very effectively with amino groups of the resin before it is crosslinked.

This grafted coating is particularly advantageous when the substrates to be adhesively bonded or to be coated exhibit very smooth, that is to say highly polished, surfaces. This is because, in these scenarios, it is not possible in the adhesion phenomena to resort to the mechanical anchoring which is very often involved in the overall adherence.

The process according to the invention advantageously makes it possible to obtain excellent chemical adhesion on these very smooth surfaces, in particular surfaces which are weakly reactive chemically, when the mechanical anchoring is not present.

Thus, by way of example, the process is of particular use for improving the adhesion of precious stones on mirror finish surfaces of precious metals.

According to another aspect, the invention relates to the use of the process according to the invention for metalizing plastics or metal or inorganic oxides, such as silica ($SiO_2$) or else indium titanium oxide (ITO).

According to yet another aspect, the invention relates to the use of the process according to the invention for functionalizing a surface of a solid support with biological molecules.

According to yet another aspect, the invention relates to the use of the process according to the invention for functionalizing a surface of a solid support with an adhesion primer comprising or consisting of a layer of polymer based on acrylic acid.

Figure 1:
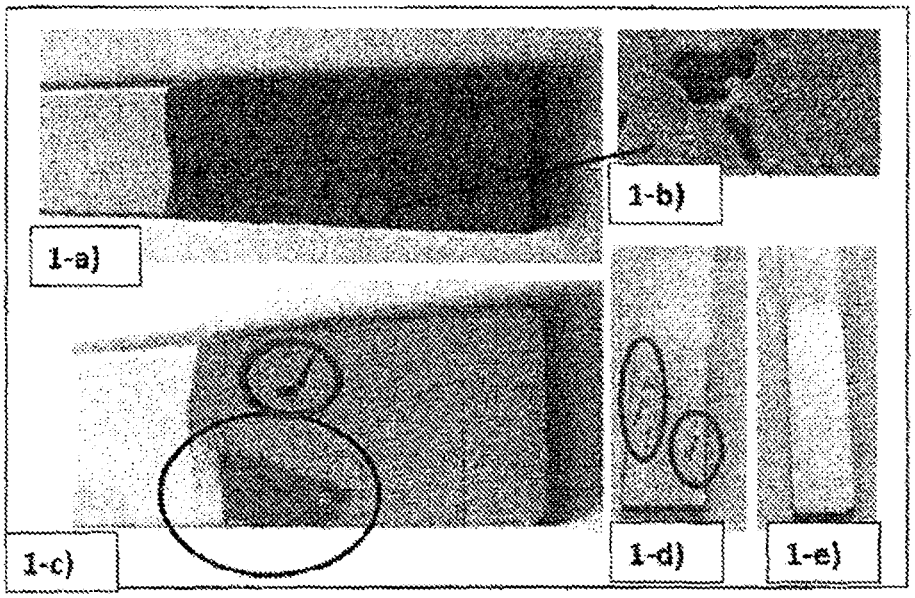
FIG. 1.

1-*a*) Photograph of a glass strip partially immersed (right-hand part (3×1 cm)) in a palladium activation bath and then in a nickel metallization bath in the presence of a PAA layer.

1-*b*) Enlargement of a portion of the metalized glass strip showing residues of bonding substance from the adhesive tape used to test the adhesion of the metal layer. Illustration of the good adhesion of the metal to the glass.

1-*c*) and 1-*d*) Photographs of two glass strips partially immersed in a palladium activation bath and then in a nickel metallization bath in the absence of a PAA layer. The test with the adhesive tape this time shows a very easy detachment of the metal layer at several locations.

1-*e*) Photograph of a glass strip partially immersed in a palladium activation bath and then in a nickel metallization bath in the presence of a residual and conforming PAA film with a thickness of a few nanometers. The heat treatment of the thin PAA film is carried out with a heat gun.

FIG. 2:

Photograph of a glass strip immersed in a palladium activation bath and then in a nickel metallization bath in the presence of a PAA film locally deposited on the surface using an adhesive stencil. The metallization took place only at the locations where PAA was deposited.

FIG. 3:

3(*a*) and 3(*b*): Photographs of a PVC surface partially immersed in a palladium activation bath and then in a nickel metallization bath in the presence of a PAA layer (a) and in the absence of a PAA layer (b).

3(*c*): Photograph of a PTFE surface which has been degreased and then partially immersed in a palladium activation bath and then in a nickel metallization bath in the absence of a PAA layer. No metallization detectable.

3(*d*): Photograph of a PTFE surface which has been immersed in a PAA solution and then partially immersed in a palladium activation bath and then in a nickel metallization bath. No metallization detectable.

3(*e*): Photograph of a PTFE surface pretreated by argon plasma, thus rendering it wetting with regard to a PAA solution in which it is immersed, then partially immersed in a palladium activation bath and then in a nickel metallization bath.

FIG. 4:

Photograph of a PVC surface locally metalized by using the PAA solution as an ink deposited by a fountain pen.

FIG. 5:

IR transmittance as a function of the wavelength of a polyimide (PI) support functionalized by PAA.

FIG. 6:

IR transmittance as a function of the wavelength of a PolyEthylene Terephthalate (PET) support functionalized by PAA

A) PET

B) PET+PAA before VUV irradiation

C) PET+PAA+VUV copiously rinsed with water, irradiated side

D) PET+PAA+VUV copiously rinsed with water, nonirradiated side.

FIG. 7:

IR transmittance as a function of the wavelength of a PolyEthylene (PE) support functionalized by PAA

A) PE

B) PE+PAA before VUV irradiation

C) PE+PAA+VUV copiously rinsed with water, irradiated side

D) PE+PAA+VUV copiously rinsed with water, nonirradiated side.

FIG. 8:

Immobilization and structuring by VUV irradiation of a thin PAA film on a gilded glass strip. Top: visible image. Bottom left: profilometric measurement carried out on the black line of the image. Bottom right: IR spectrum outside and inside the irradiated region.

FIG. 9:

(a) chemical mechanism responsible for the adhesion of the amine hardener of the resin to the anhydride groups of the support.

(b): results of the standardized adhesion tests in the absence (top) and in the presence (bottom) of the anhydride layer.

(c): representation of the surface of the substrate after the adhesion tests in the absence (top) and in the presence (bottom) of the anhydride layer (red line).

FIG. 10:

Increase in the surface energy of the hydrophobic PVC. Measurement of the contact angles before (left—70°) and after (right—30°) treatment.

FIG. 11:

Decrease in the surface energy of a gilded surface. Hydrophilic gold layer became hydrophobic by grafting a long alkyl layer. Top: IR transmittance as a function of the wavelength of a gilded support (gold layer evaporated onto glass) functionalized by PAA and grafted by a Cu alkyl amine. Bottom: Measurement of the contact angles. (Left) Gold alone, (center) Gold+PAA, (right) Gold+PAA+$C_{11}$ amine.

FIG. 12:

IR transmittance as a function of the wavelength of a support made of gold functionalized by an adsorbed residual layer of PAA.

FIG. 13:

IR transmittance as a function of the wavelength relating the different stages of grafting of proteins with activation of the surface in an organic medium.

a) Spectrum of PAA grafted to a gilded support and modified at the surface via the formation of functional groups of activated ester (COOSu) type b) Spectrum of PAA grafted to a gilded support, after coupling of the functional groups of activated ester (COOSu) type with a protein. The spectrum of the protein alone is superimposed.

FIG. 14:

IR transmittance as a function of the wavelength relating the different stages of grafting of proteins with activation of the surface in an aqueous medium.

a) Spectrum of the functionalized PAA support after NHS/EDC activation in an aqueous medium: formation of the anhydride functional groups by the chemical route.

b) Spectrum of the support activated as anhydride functional groups after coupling of these functional groups with a protein.

c) Spectrum of the PAA-functionalized support after NHS/EDC activation in an aqueous medium, having been immersed in DI water at a pH equal to 6 for 15 minutes: persistence of the anhydride functional groups.

FIG. 15:

Photographs a) of the fibers of the virgin carbon felt before coating and b) and c) of the fibers of the carbon felt coated with the PAA film.

FIG. 16:

Treated carbon felts and column treatment device.

FIG. 17:

Metallization of a sheet of carbon-epoxy composite used in the aeronautical industry.

FIG. 18:

Energy of different chemical bonds as a function of the wavelength.

The following examples illustrate the invention without, however, limiting it.

DETAILED DESCRIPTION

Examples

Example 1: Metallization of the Surfaces

Example 1-a/: Full Surface Metallization of a Glass Surface. (Heat Treatment)

i) Coating and Immobilization of the Coating of Acrylic Acid Polymer (PAA).

A PAA ($M_n$ 130 000) solution with a concentration of 50 mg in 10 ml of ethanol is prepared by dissolution.

A glass strip of microscope slide type (7.5×2.5 cm) is degreased (washing with a surfactant typically followed by an alcohol rinsing) and then dried (with a dry nitrogen gas blower and then by placing in an oven at 100° C. for 15 min).

For a metallization of full surface type, the PAA solution is applied by dipping-withdrawing (immersion-emersion) in order to obtain, after evaporation of the ethanol, a covering and homogeneous PAA film with a thickness of 50 to 70 nm. The deposition of PAA takes place then on both sides of the glass strip (FIG. 1).

The glass strips coated with the PAA are then typically heated at 200° C. for 30 min in an ordinary oven at atmospheric pressure and without specific precautions.

ii) Activation

Preparation of the activation solution. The solution can be prepared in advance.

Typically:

70 mg of palladium acetate ($Pd(CH_3CO_2)_2$), 50 ml 0.5M HCl, 150 ml of distilled water (DI) and 1.4 g of NaCl. Wait until dissolution is complete. Adjust the pH to between 5 and 6 with concentrated NaOH and HCl solutions.

For the activation of the PAA layer, the glass strips are first of all immersed in an aqueous solution of pH=9 in order to rapidly hydrolyze the anhydrides, thus restoring the chemical formula of the PAA. Then the glass strips are placed at ambient temperature for 10 min in the activation solution. Rinsing with DI water is carried out.

iii) Metallization

The activated glass strip is immersed in an electroless bath (that is to say, a nonelectrolytic bath) regulated at the temperature of 34° C.

The bath is typically a commercial Niposit™ PM 988 bath. Its pH is 9.4. The reducing agent is sodium hypophosphite ($NaH_2PO_2.H_2O$).

The activated glass strips are left for 10 minutes in order to have a complete and homogeneous metallization.

A rinsing operation with water and then a drying operation with the dry gas blower are sufficient. The thickness of the nickel film is typically 500 nm.

iv) Adherence/Adhesion of the Metal Coating to the Substrate

The adherence/adhesion of the metal layer is determined by applying the standardized Scotch tape test ASTM D3359.

v) Comparative Substrate

By way of comparison, a glass strip which has not been covered with a PAA layer was metalized by immersion in the palladium acetate activation solution described above. Due to the hydrophilic nature of the glass substrate, the palladium ions are adsorbed on the surface. This strip is subsequently transferred into the electroless bath and the metallization process takes place. A rinsing operation of water and then a drying operation with the dry gas blower are sufficient. The thickness of the nickel film is typically 200 nm.

vi) Results

FIG. 1 shows:

1-*a*): photograph of a glass strip metalized over a portion (right-hand part); the glass which has not been coated with PAA in the left-hand part.

1-*b*): residues of the layer of bonding substance of the Scotch Tape® which has been used to carry out the adhesion test and which have remained adhesively bonded to the metal are observed. There is thus cohesive failure of the adhesive tape used for the adhesion test. The adhesive strength of the metal on the glass is thus greater than that of the bonding substance of the adhesive on its own band (which is rarely observed).

1-*c*) and 1-*d*): comparative example: metallization without PAA. The adhesion test with adhesive tape carried out on a portion of the metalized strip (black circle) shows the detachment of the metal film. At different locations (red circles), it is observed that the internal stress of the metal film is sufficient to spontaneously produce a partial detachment of the metal film.

Example 1-b/: Full Surface Metallization of a Glass Surface with a PAA Film with a Conforming Residual Thickness. (Heat Treatment)

i) Coating and Immobilization of the Coating of Polymer with Acrylic Acid (PAA).

A PAA ($M_n$ 130 000) solution with a concentration of 5 mg in 10 ml of ethanol is prepared by dissolution.

A glass strip of microscope slide type (7.5×2.5 cm) is degreased (washing with a surfactant typically followed by an alcohol rinsing) and then dried by a heat gun for one minute at a temperature exceeding 200° C. without exceeding 300° C.

For a metallization of full surface type, the PAA solution is applied by dipping-withdrawing (immersion-emersion) in order to obtain, after evaporation of the ethanol, a covering and homogenous PAA film with a thickness of 10 nm. The deposition of PAA takes place then on both sides of the glass strip.

The glass strips coated by the PAA are then typically rinsed with deionized water in order to remove the nonadsorbed PAA chains. The polyelectrolytic interactions govern the persistence of a thin residual film of a few nanometers (less than 5 nm). This residual film is subsequently heat treated by a heat gun for 90 seconds at a temperature exceeding 200° C. and not exceeding 300° C.

ii) Activation with Palladium

Preparation of the activation solution. The solution can be prepared in advance.

Typically:

13 mg of $Pd(NH_3)_4Cl_2$ per 1 ml of deionized water. As the PAA film is thin, unlike the preceding example, the anhydride form is immersed directly in the palladium solution for 2 minutes. Hydration of the anhydrides and the complexing of the palladium take place concomitantly. A drying operation with the nitrogen blower is carried out.

iii) Metallization

The activated glass strip is immersed in an electroless bath (that is to say, a nonelectrolytic bath) regulated at the temperature of 34° C. The bath is typically a commercial Niposit™ PM 988 bath. Its pH is 9.4. The reducing agent is sodium hypophosphite ($NaH_2PO_2.H_2O$).

The activated glass strips are left for 10 minutes in order to have a complete and homogeneous metallization.

A rinsing operation with water and then a drying operation with the dry gas blower are sufficient. The thickness of the nickel film is typically 500 nm.

iv) Results

FIG. 1-*e*) shows that a PAA film of a residual thickness (less than 5 nm), by virtue of its perfectly conforming nature, makes it possible to obtain a metal layer of high optical quality of "mirror finish" type. Furthermore, a test with the adhesive tape was carried out and no detachment was observed.

Example 1-c/: Localized Metallization of a Glass Surface. (Heat Treatment)

i) Coating and Immobilization of the PAA Coating.

A PAA ($M_n$ 130 000) solution with a concentration of 50 mg in 10 ml of ethanol is prepared by dissolution.

A glass strip of microscope slide type (7.5×2.5 cm) is degreased (washing with a surfactant followed by an alcohol rinsing) and then dried (by a dry nitrogen gas blower and then by placing in an oven at 100° C. for 15 min).

Figure 2:
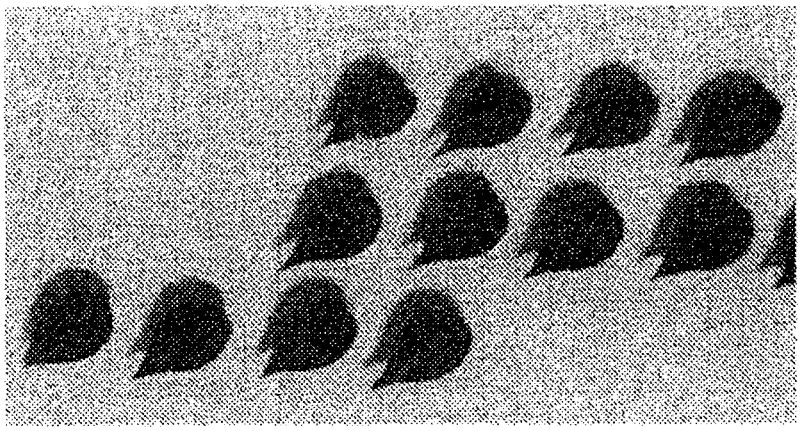

For a localized metallization, the PAA solution is applied with a stencil (masking) and a sprayer. The pattern of the adhesive stencil is in this instance drops of water (FIG. 2).

The adhesive stencil is removed after drying the PAA layer.

The glass strips coated with the PAA are then typically heated at 200° C. for 30 min in an ordinary oven at atmospheric pressure and without specific precautions.

ii) Activation.

Preparation of the activation solution. The solution can be prepared in advance.

Typically:

70 mg of palladium acetate ($Pd(CH_3CO_2)_2$). 50 ml of 0.5M HCl, 150 ml of DI $H_2O$ and 1.4 g of NaCl. Wait until dissolution is complete. Adjust the pH to between 5 and 6 with concentrated NaOH and HCl solutions.

For the activation of the PAA layer, the glass strips are first of all immersed in an aqueous solution of pH=9 in order to rapidly hydrolyze the anhydrides and to thus restore the chemical formula of the PAA. Then the glass strips are placed at ambient temperature for 10 min in the activation solution. Rinsing with DI water is carried out.

iii) Metallization.

The activated glass strip is immersed in the electroless bath regulated at the temperature of 34° C.

The bath is typically a commercial Niposit™ PM 988 bath. Its pH is 9.4. The reducing agent is sodium hypophosphite ($NaH_2PO_2.H_2O$).

The activated glass strips are left for 10 minutes in order to have a complete and homogeneous metallization.

A rinsing operation with water and then a drying operation with the dry gas blower are sufficient. The thickness of the nickel film is typically 500 nm.

iv) Results

FIG. 2 shows that only the regions initially coated with PAA have been metalized.

Example 1-d/: Full Surface Metallization of a PVC Surface. (VUV Radiative Treatment)

Coating and immobilization of the PAA coating.

A PAA (typically $M_n$ 130 000) solution with a concentration typically of 50 mg in 10 ml of ethanol is prepared by dissolution.

The flexible PVC sheet (format and manufacture for a credit card) is degreased (typically washing with a surfactant typically followed by an alcohol rinsing) and then dried (typically by a dry nitrogen gas blower).

Figure 3:
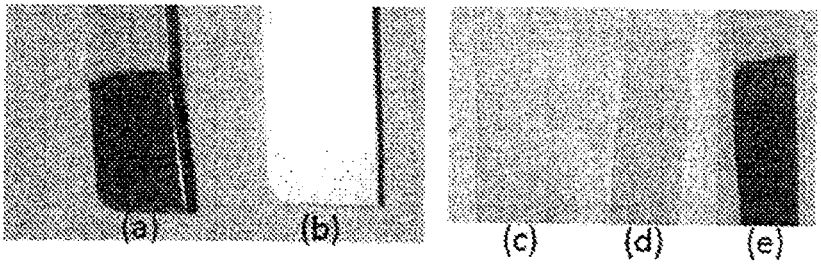

For a metallization of full surface type, the PAA solution is typically applied by dipping-withdrawing (immersion-emersion) in order to obtain, after evaporation of the ethanol, a covering and homogeneous PAA film with a thickness typically of 50 to 70 nm. The PAA deposition will take place then on both sides of the PVC sheet (FIG. 3).

The PVC sheets are typically subjected to irradiation by VUV (Vacuum Ultraviolet) radiation for two minutes at a distance of 15 cm in an atmosphere purged of air by flushing with thy nitrogen. The characteristics of the VUV lamp are: excimer lamp of the Osram brand, Xeradex model. Power of 140 W. Radiation 150 to 190 nm with maximum at 172 nm.

ii) Activation.

Preparation of the activation solution. The solution can be prepared in advance.

Typically:

70 mg of palladium acetate ($Pd(CH_3CO_2)_2$), 50 ml of 0.5M HCl, 150 ml of DI $H_2O$ and 1.4 g of NaCl. Wait until dissolution is complete. Adjust the pH to between 5 and 6 with concentrated NaOH and HCl solutions.

For the activation of the PAA layer, the PVC sheets are placed at ambient temperature for 10 min in the activation solution. Rinsing with DI water is carried out.

iii) Metallization.

The activated PVC sheet is immersed in the electroless bath regulated at the temperature of 34° C.

The bath is typically a commercial Niposit™ PM 988 bath. Its pH is 9.4. The reducing agent is sodium hypophosphite ($NaH_2PO_2.H_2O$).

The activated PVC is left for 10 minutes in order to have a complete and homogeneous metallization.

A rinsing operation with water and then a drying operation with the dry gas blower are sufficient. The thickness of the nickel film is typically 500 nm.

iv) Comparative Substrate

By way of comparison, a PVC sheet which has not been covered with a PAA layer is immersed in the solution of activator based on palladium acetate described above. However, due to the hydrophobic nature of this material, the $Pd^{2+}$ ions cannot be adsorbed on the substrate and initiate the metallization process.

v) Results

The metalized (activation and metallization) region corresponding to the presence of the PAA coating is presented in FIG. 3-*a*). FIG. 3-*b*) shows the result of the same experiment but in the absence of coating and immobilization of a PAA coating.

Example 1-e/: Full Surface Metallization of a PTFE Support. (VUV Radiative Treatment)

Plasma activation of the surface of the Teflon.

An argon plasma treatment of 10 minutes makes it possible for the surface of the support made of PTFE to be homogeneously wetted by the PAA solution and to thus deposit a PAA film of homogeneous thickness. On the face not exposed to the plasma, the wettability was not sufficient to coat the PTFE with the PAA film.

ii) Coating and Immobilization of the PAA Coating.

A PAA ($M_n$ 130 000) solution with a concentration typically of 50 mg in 10 ml of ethanol is prepared by dissolution.

For a metallization of full surface type, the PAA solution is typically applied by dipping-withdrawing (immersion-emersion) in order to obtain, after evaporation of the ethanol, a covering and homogeneous PAA film with a thickness typically of 50 to 70 nm.

The PTFE supports coated with the PAA are then typically heated at 200° C. for 30 min in an ordinary oven at atmospheric pressure and without specific precautions.

At this stage, the PAA is in the form of anhydride functional groups. An immersion for 10 minutes in water makes it possible to hydrolyze the anhydride functional groups and to restore the chemical form of the PAA.

iii) Activation with Palladium.

Preparation of the activation solution. The solution can be prepared in advance.

Typically:

70 mg of palladium acetate $Pd(CH_3CO_2)_2$, 50 ml of 0.5M HCl, 150 ml of DI $H_2O$ and 1.4 g of NaCl. Wait until the dissolution is complete. Adjust the pH to between 5 and 6 with concentrated NaOH and HCl solutions.

For the activation of the PAA layer, the PTFE supports are placed at ambient temperature for 10 min in the activation solution. A rinsing operation with DI water is carried out.

iv) Metallization.

The activated PTFE support is immersed in the electroless bath regulated at the temperature of 34° C.

The bath is typically a commercial Niposit™ PM 988 bath. Its pH is 9.4. The reducing agent is sodium hypophosphite ($NaH_2PO_2.H_2O$).

The activated PTFE is left for 10 minutes in order to have a complete and homogeneous metallization.

A rinsing operation with water and then a drying operation with the dry gas blower are sufficient. The thickness of the nickel film is typically 500 nm.

v) Comparative Substrate

By way of comparison, PTFE supports which have not been covered (FIG. 3-*c*) or which have been poorly covered (FIG. 3-*d*) with a PAA layer are immersed in the activated solution based on palladium acetate described above. However, due to the hydrophobic nature of this material, the $Pd^{2+}$ ions and/or the PAA coating cannot be adsorbed on the substrate and make possible the development of the metallization process.

vi) Results

FIG. 3-*e* shows the metalized (activation and metallization) region corresponding to the presence of the PAA coating.

Example 1-f/: Local Metallization of a PVC Surface. (Radiative Treatment)

i) Coating and Immobilization of the PAA Coating.

A PAA ($M_n$ 130 000) solution with a concentration typically of 50 mg in 10 ml of ethanol is prepared by dissolution.

The flexible PVC sheet (format and manufacture for a credit card) is degreased (washing with a surfactant typically followed by an alcohol rinsing) and then dried (typically by a dry nitrogen gas blower).

Figure 4:
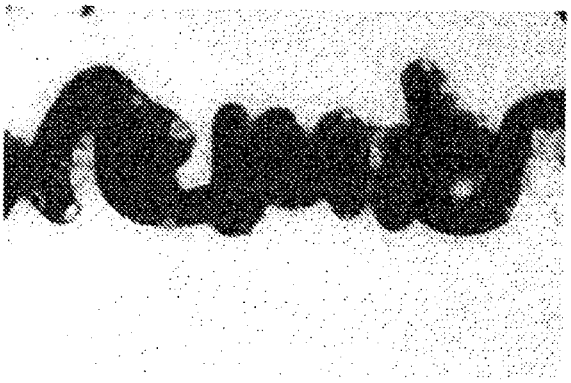

The deposition of the PAA solution is localized in this example by using a writing pen dipped beforehand in the PAA solution (FIG. 4).

The PVC sheets are typically subjected to irradiation by VUV radiation for two minutes at a distance of 15 cm in an atmosphere purged of air by flushing with dry nitrogen. The characteristics of the VUV lamp are: excimer lamp of the Osram brand, Xeradex model. Power of 140 W. Radiation 150 to 190 nm with maximum at 172 nm.

ii) Activation.

Preparation of the activation solution. The solution can be prepared in advance.

Typically:

70 mg of palladium acetate ($Pd(CH_3CO_2)_2$), 50 ml of 0.5M HCl, 150 ml of DI $H_2O$ and 1.4 g of NaCl. Wait until dissolution is complete. Adjust the pH to between 5 and 6 with concentrated NaOH and HCl solutions.

For the activation of the PAA layer, the PVC sheets are placed at ambient temperature for 10 min in the activation solution. Rinsing with DI water is carried out.

iii) Metallization.

The activated PVC sheet is immersed in the electroless bath regulated at the temperature of 34° C.

The bath is typically a commercial Niposit™ PM 988 bath. Its pH is 9.4. The reducing agent is sodium hypophosphite ($NaH_2PO_2.H_2O$).

The activated PVC is left for 10 minutes in order to have a complete and homogeneous metallization.

A rinsing operation with water and then a drying operation with the dry gas blower are sufficient. The thickness of the nickel film is typically 500 nm.

iv) Results

FIG. 4 shows that a localized metallization of the PVC has been obtained: the metalized parts were obtained using the PAA solution as an ink. The pattern was produced with a writing pen.

Example 2: Immobilization of the PAA on Different Polymer Supports

Example 2-a/: Thermal Immobilization of PAA on Polyimide i) Coating of the Support.

A PAA ($M_n$ 130 000) solution with a concentration of 100 mg in 10 ml of ethanol is prepared by dissolution.

A flexible polyimide (PI) sheet of 50 μm is degreased (washing with a surfactant followed by an alcohol rinsing) and then dried (by a dry nitrogen gas blower and then by placing in an oven at 100° C. for 15 min).

Figure 5:
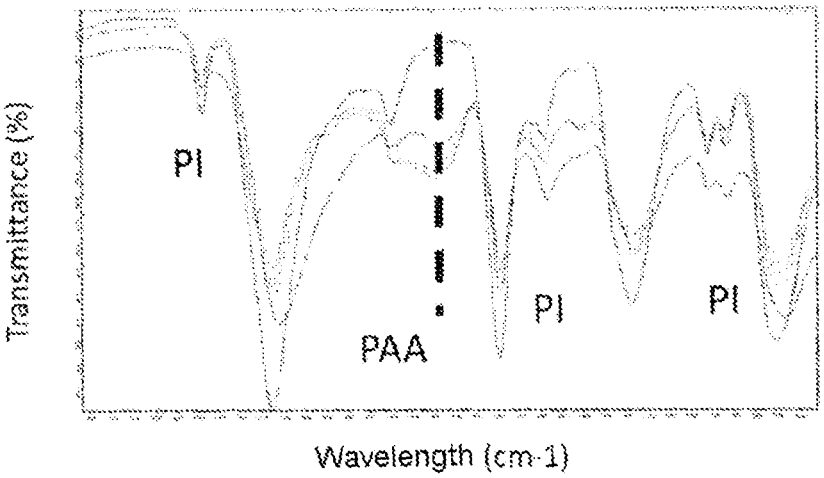

For a coating of full surface type, the PAA solution is typically applied by dipping-withdrawing (immersion-emersion) in order to obtain, after evaporation of the ethanol, a covering and homogeneous PAA film with a thickness typically of 150 to 250 nm. The PAA deposition will then take place on both sides of the polyimide sheet (FIG. 5).

ii) Immobilization of the PAA on the Support

The flexible polyimide sheets coated with the PAA are then typically heated at 200° C. for 30 min in an ordinary oven at atmospheric pressure and without specific precautions.

At this stage, the PAA is in the form of anhydride functional groups which can be used in order to be coupled to other complementary functional groups of advantageous materials.

An immersion in water for 10 minutes makes it possible to hydrolyze the anhydride functional groups and to restore the chemical form of the PAA.

FIG. 5 shows that the peaks related to the presence of a PAA film of 200 nm on the PI persist after a washing operation in water lasting 120 h.

Example 2-b/: Immobilization by Subjecting to VUV Irradiation a PAA Film on a Flexible Polyethylene Terephthalate (PET) Sheet 1) Coating of the Support A PAA (typically $M_n$ 130 000) solution with a concentration typically of 50 mg in 10 ml of ethanol is prepared by dissolution.

A flexible polyethylene terephthalate (PET) sheet of 50 μm is degreased (typically washing with a surfactant typically followed by an alcohol rinsing) and then dried (typically by a dry nitrogen gas blower).

Figure 6:
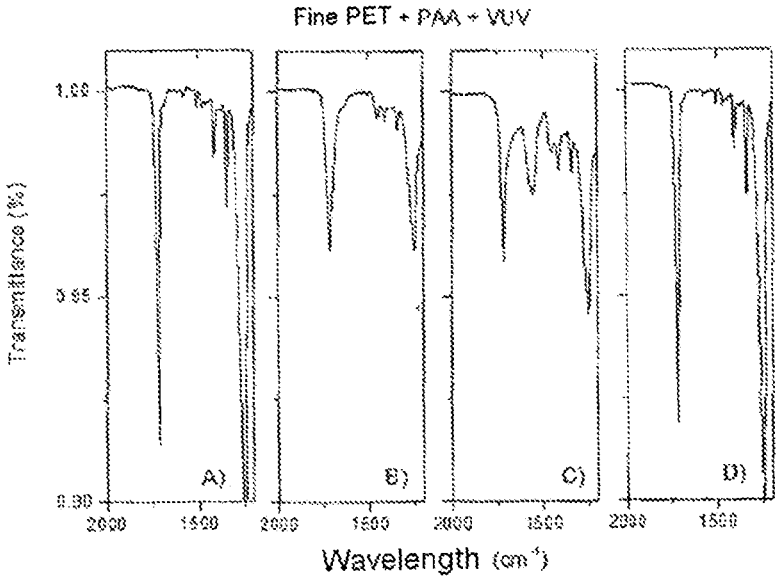

For a coating of full surface type, the PAA solution is typically applied by dipping-withdrawing (immersion-emersion) in order to obtain, after evaporation of the ethanol, a covering and homogeneous PAA film with a thickness typically of 50 to 70 nm. The PAA deposition will take place then on both sides of the PET sheet (FIG. 6).

ii) Immobilization of the PAA on the Support

The flexible PET sheets coated with the PAA are then typically irradiated by VUV (Vacuum Ultraviolet) radiation for 2 minutes at a distance of 15 cm in an atmosphere purged of air by flushing with dry nitrogen. The characteristics of the VUV lamp are: excimer lamp of the Osram brand, Xeradex model. Power of 140 W. Radiation 150 to 190 nm with a maximum of 172 nm.

The persistence of the PAA film in its carboxylate form due to the rinsing with water, irradiated side, and the removal of the PAA, nonirradiated side, are seen in FIGS. 6*c* and 6*d*.

Example 2-c/: Immobilization by Subjecting to VUV Irradiation a PAA Film on a Flexible Polyethylene (PE) Sheet i) Coating of the Support A PAA ($M_n$ 130 000) solution with a concentration of 50 mg in 10 ml of ethanol is prepared by dissolution.

A flexible Polyethylene (PE) sheet of 50 μm is degreased (washing with a surfactant followed by an alcohol rinsing) and then dried (by a dry nitrogen gas blower).

Figure 7:
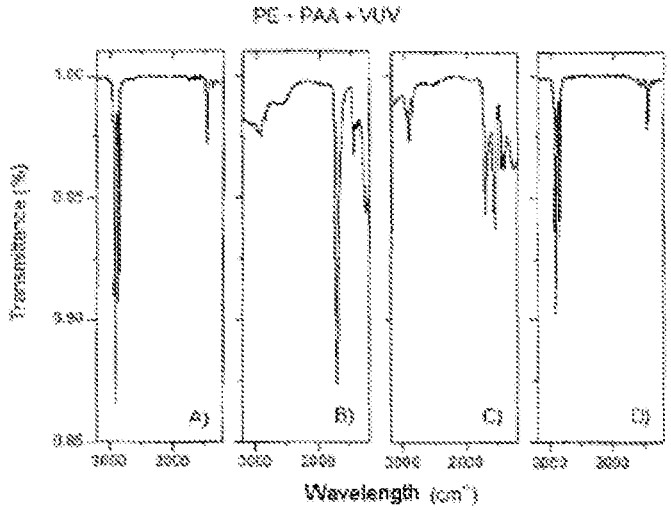

For a coating of full surface type, the PAA solution is applied by dipping-withdrawing (immersion-emersion) in order to obtain, after evaporation of the ethanol, a covering and homogeneous PAA film with a thickness typically of 50 to 70 nm. The PAA deposition will take place then on both sides of the PE sheet (FIG. 7). An oxidative pretreatment of the surface by UV-ozone or oxygen plasma can be carried out before the coating thereof in order to improve the wetting of the PAA solution.

ii) Immobilization of the FAA on the Support

The flexible PE sheets coated with the PAA are then irradiated by VUV (Vacuum Ultraviolet) radiation for 2 minutes at a distance of 15 cm in an atmosphere purged of air by flushing with dry nitrogen. The characteristics of the VUV lamp are: excimer lamp of the Osram brand, Xeradex model. Power of 140 W. Radiation 150 to 190 nm with a maximum at 172 nm.

The persistence of the PAA film in its acid and carboxylate form due to the rinsing with water, irradiated side, and the removal of the PAA, nonirradiated side, are seen in FIGS. 7*c* and 7*d*.

Example 3: Immobilization and Structuring by Subjecting to VUV Irradiation a Thin Film of PAA on Gold This example demonstrates the possibility of immobilizing and structuring a thin film of PAA on any one surface at submillimetric scales by photolithographic methods.

Coating of the Support

A PAA ($M_n$ 130 000) solution with a concentration of 100 mg in 10 ml of ethanol is prepared by dissolution.

A gold surface (gilded glass strip) is cleaned by UV-ozone treatment for 5 minutes in order to remove the surface organic contaminants.

For a coating of full surface type, the PAA solution is applied by dipping-withdrawing (immersion-emersion) in order to obtain, after evaporation of the ethanol, a covering and homogeneous PAA film with a thickness typically of 150 to 250 nm.

ii) Structuring of the Coated Support and Immobilization of the PAA

A mask is deposited by direct contact on the gold surface coated with the PAA and then the assembly is irradiated with VUV (Vacuum Ultraviolet) radiation for 15 minutes at a distance of 7 cm in an atmosphere purged of air by flushing with dry nitrogen. The characteristics of the VUV lamp are: excimer lamp of the Osram brand, Xeradex model. Power of 140 W. Radiation 150 to 190 nm with a maximum at 172 nm.

Figure 8:
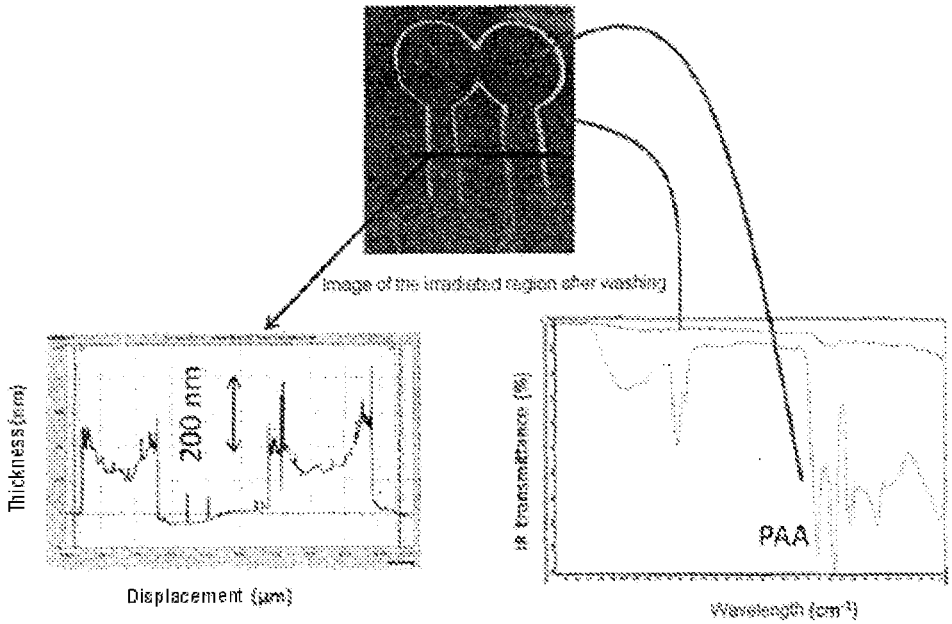

After irradiation, the mask is removed and the sample is copiously washed with water. The PAA film which has not been subjected to the irradiation is removed by the washing with water, whereas the irradiated film for its part withstands this washing operation. The experiment is illustrated by FIG. 8. The photographic image (at the top) of the gold surface after the VUV irradiation and the effective removal of the nonirradiated PAA by washing with water is examined. The white lines of the optical image correspond to the drying rims. Within the white lines, the PAA film is grafted by subjecting to irradiation and withstands copious rinsing with water. Outside the white lines, the PAA film has been removed by the copious rinsing with water.

The black line represents the line measured by profilometry (at the bottom at the left) and makes it possible to see that the difference of thickness between the irradiated region and the nonirradiated region is of the order of 200 nm, i.e. of the same order of magnitude as the initial thickness of the PAA film on the gilded substrate. This demonstrates i) the lack of effect of the washing with water on the PAA deposit in the irradiated region and ii) the effectiveness of the washing in removing virtually all of the deposit in the nonirradiated region.

This is confirmed by the IR analyses (at the bottom on the right) carried out in the different regions after washing:

i) in the irradiated region after washing with water, the absorption bands characteristic of the PAA film remain clearly visible and strong, ii) in the nonirradiated regions after washing with water, the very weak intensities detected confirm the virtually complete removal of the deposit.

Example 4: Structural Adhesive Bonding Via the Anhydride Groups. (Heat Treatment)

Example 4-a/: Adhesive Bonding of an Epoxy Resin to a Stainless Steel Surface i) Coating of the Support A PAA ($M_n$ 130 000) solution with a concentration of 50 mg in 10 ml of ethanol is prepared by dissolution.

A stainless steel strip, mechanically polished down to a roughness of 1 μm (mirror), is degreased (typically washing with a surfactant typically followed by an alcohol rinsing) and then dried (typically by a dry nitrogen gas blower and then by placing in an oven at 100° C. for 15 min).

For a coating of full surface type, the PAA solution is typically applied by dipping-withdrawing (immersion-emersion) in order to obtain, after the evaporation of the ethanol, a covering and homogenous PAA film with a thickness typically of 70 to 100 nm.

ii) Immobilization of the PAA on the Support

The stainless steel surfaces coated with the PAA are then typically heated at 200° C. for 30 min in an ordinary oven at atmospheric pressure and without specific precautions.

The heating will make it possible to cause the PAA to adhere to the stainless steel, to form reactive anhydride groups and to crosslink the film by decarboxylation.

iii) Structural Adhesive Bonding to the Coated Support

Preparation of the epoxy resin of two-component type: Epiglass HT900 (epoxy resin and amine hardener) in an 80-20 proportion.

The mixture is prepared and applied as a thin layer of 300 μm to the stainless steel (use of a stencil of screenprinting type). The bubbles are eliminated naturally in 5 minutes and a final drying is carried out at 100° C. for one hour.

The epoxy film is applied to a virgin stainless steel surface (comparative substrate) and under the same conditions to a stainless steel surface with a PAA-anhydride coating.

A standardized adhesion test with Scotch tape ASTM D3359 is carried out ("squares" tests with a six-bladed scratching tool).

Figure 9:
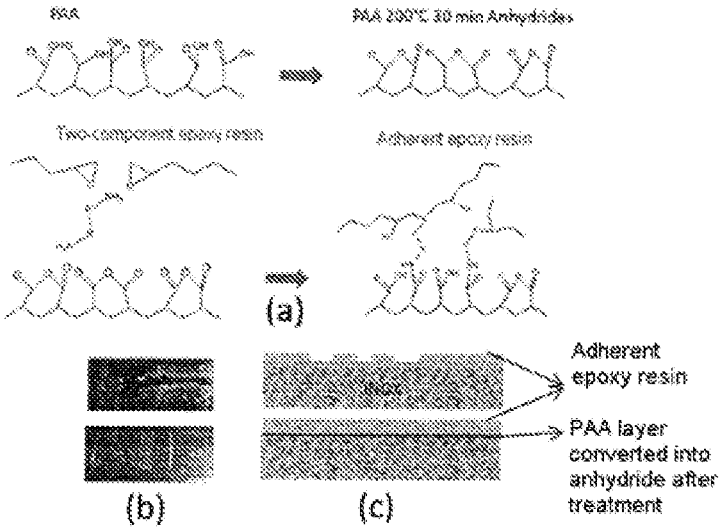

The test in which the Scotch tape is torn off the stainless steel which has been simply polished (comparative substrate) results in a significant detachment of the epoxy film beyond the cross-hatched region. The same test in which the Scotch tape is torn off the stainless steel coated with the PAA-anhydride does not show any detachment, even after several tests. The amine functional groups of the hardener, before the resin has completely hardened, have spontaneously reacted with the anhydride functional groups of the coated surface. The results and the chemical mechanism of grafting between the resin and the PAA-anhydride film are shown in FIG. 9.

Example 5: Control of the Surface Energy of a Substrate

Example 5-a/: A Hydrophilically Modified Hydrophobic Substrate (PVC)

A PAA (typically $M_n$ 130 000) solution with a concentration typically of 50 mg in 10 ml of ethanol is prepared by dissolution.

The flexible PVC sheet (format and manufacture for a credit card) is degreased (typically washing with a surfactant typically followed by an alcohol rinsing) and then dried (typically by a dry nitrogen gas blower). At this stage, the PVC surface is very hydrophobic.

For a treatment of full surface type, the PAA solution is typically applied by dipping-withdrawing (immersion-emersion) in order to obtain, after evaporation of the ethanol, a covering and homogeneous PAA film with a thickness typically of 50 to 70 nm.

The PVC sheets are typically subjected to irradiation by VUV (Vacuum Ultraviolet) radiation for two minutes at a distance of 15 cm in an atmosphere purged of air by flushing with dry nitrogen. The characteristics of the VUV lamp are: excimer lamp of the Osram brand, Xeradex model. Power of 140 W. Radiation 150 to 190 nm with maximum at 172 nm.

The surface energy of the substrate is determined by the measurement of the contact angle. The contact angle measurements were carried out with a device of Apollo Instrument brand, controlled via the Sca 20 software.

Figure 10:
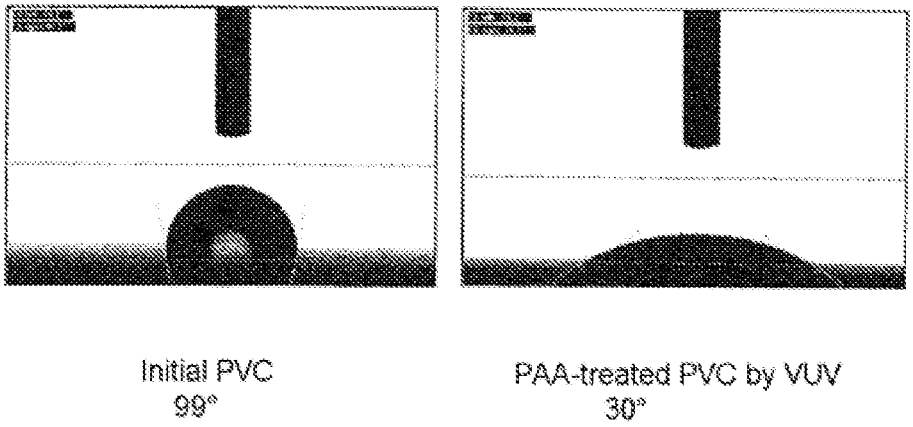

The results observed are shown in FIG. 10. The crude PVC is very hydrophobic when it is clean and exhibits a contact angle of approximately 100°. Its surface energy is low. Once modified by a grafted film of PAA, the surface energy is increased and the contact angle measured is approximately 30°.

Example 5-b/: A Hydrophobically Modified Hydrophilic Substrate (Glass Substrate Covered with a Gold Layer)

A PAA (typically $M_n$ 130 000) solution with a concentration typically of 50 mg in 10 ml of ethanol is prepared by dissolution.

A glass strip of microscope slide type (7.5×2.5 cm) covered with a gold layer (gilded substrate) is directly treated with UV-ozone for 5 min in order to remove the traces of organic contamination of atmospheric origin.

For a coating of full surface type, the PAA solution is typically applied by dipping-withdrawing (immersion-emersion) in order to obtain, after evaporation of the ethanol, a covering and homogeneous PAA film with a thickness typically of 50 to 70 nm. The glass strips coated with the PAA are then typically heated at 200° C. for 30 min in an ordinary oven at an atmospheric pressure and without specific precautions.

The heating will make it possible to cause the PAA to adhere to the gilded substrate, to form reactive anhydride groups and to crosslink the film by decarboxylation.

Figure 11:
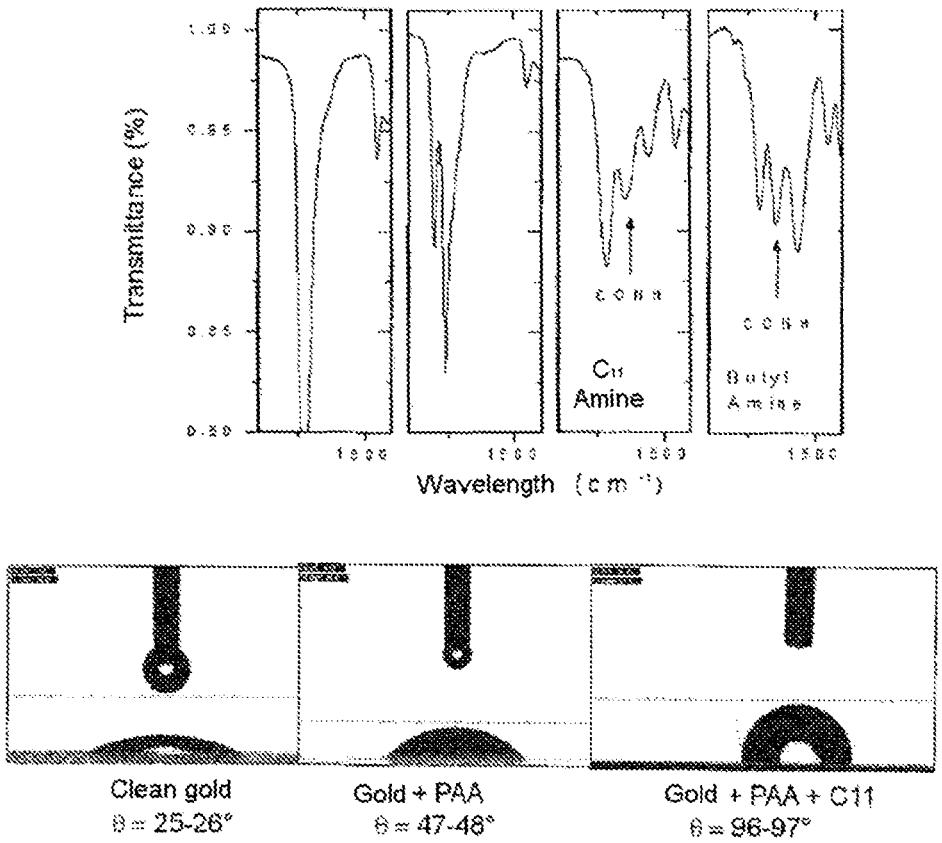

A molecule comprising a hydrophobic part ($C_{11}$ alkyl group) and a primary amine functional group is applied to the activated surface, in a pure (undiluted) form, by laying down a drop and by then spreading it with the application of a coverglass on top, or in a form diluted in a solvent, for example of hexane or cyclohexane type, which does not interfere with the coupling reaction between the anhydrides and the amines (FIG. 11). (cf scheme below).

The contact angle of the clean gold after a UV-03 treatment lies between 20 and 30°. This substrate coated with the PAA exhibits a contact angle typically between 30 and 50°. Then, when the $C_{11}$ amine is grafted to the substrate coated with PAA, this contact angle reaches 100°. IR spectroscopy makes it possible to demonstrate the chemical reaction between the acid surface of the gilded substrate covered with PAA and the amine by the presence of the amide bands (FIG. 11).

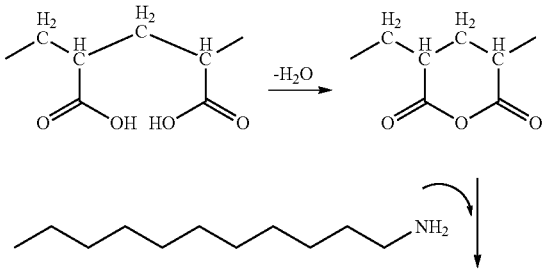

-continued

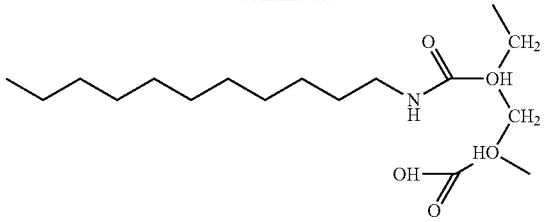

Spontaneous chemical reaction between anhydrides and amines

Example 6: Preparation of PAA Film with a Residual and Constant Thickness

For biological applications in SPRI (surface plasmon resonance imaging), for example, or for applications for the preparation of reflecting surfaces (metalized surface of "mirror finish" optical quality), it is valued to have very fine and very homogeneous PAA layers (conforming to the surface).

The methods of coating by projection or by transfer are limited in the quality of deposition by the stage of application and then of evaporation of the solvent, which are never perfectly homogeneous.

PAA is a polyelectrolyte which can be adsorbed by electrostatic interactions on certain surfaces. These interactions develop over a distance which is dependent on the nature of the polymer and on the substrate and can consequently be variable. The balance of these different forces results in the deposition of a thin layer of perfectly defined thickness after several successive rinsing operations. The asymptotic thickness obtained after the rinsing operations is then governed by the surface.

One method for the preparation of these thin conforming PAA layers consists in applying a PAA coating with a thickness greater than the desired thickness without specific precautions and in then removing, by rinsing, the PAA polymer chains which do not interact physically with the surface.

By way of example, a PAA film is deposited by dipping-withdrawing (immersion-emersion) on a support made of gold (deposition of a gold layer on a glass strip) in order to obtain, after evaporation of the ethanol, a covering and homogeneous PAA film with a thickness typically of 50 to 70 nm.

Prolonged rinsing operations with water, which is a very good solvent for PAA, are subsequently carried out in order to remove the polymer which does not interact with the surface, until a residual PAA film of stable thickness is obtained.

Figure 12:
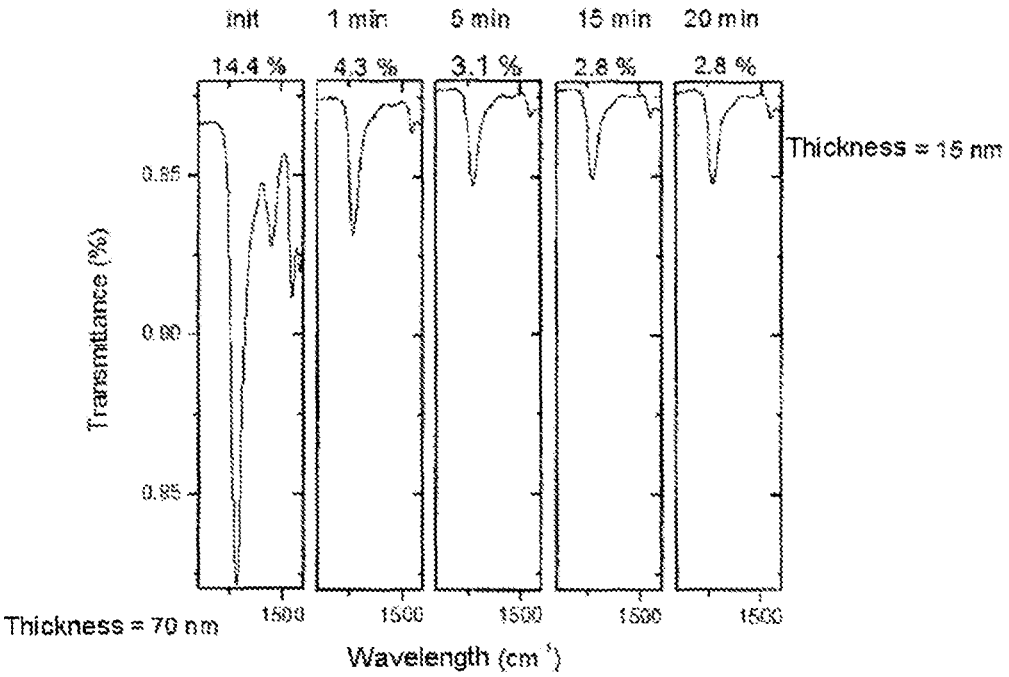

The residual films obtained on gold asymptotically converge toward a constant thickness of 15 nm, as is shown by the IR intensities of FIG. 12. This residual thickness is controlled by the polyelectrolytic interactions in connection with the surface properties.

These films are highly reproducible in thickness and conform perfectly to the surface (FIG. 12).

A final annealing at 200° C. for 30 minutes makes it possible to definitively stabilize the film and again to make use of either the anhydride or acid functional groups for chemical couplings.

By way of example, it is possible to obtain the metallization of a glass strip with the "mirror finish" optical quality by applying the metallization process starting from a PAA coating layer of conforming residual layer type (cf example 1-b), FIG. 1-*e*).

Example 7: Coupling of Biological Molecules to a PAA Surface

The stable coupling of biological molecules to a surface is an important objective of numerous analytical and medical diagnosis methods.

The following example illustrates the possibility of chemically and covalently grafting proteins to an activated adhesion primer itself covalently grafted to a substrate.

In a first step, activated surfaces are created and then these activated surfaces are used to carry out the coupling proper with the proteins.

The coupling of the proteins is carried out conventionally for biologists by passing through the activated form of the acid, referred to as activated ester. This activated ester reacts favorably in a buffered medium with the amine groups of the proteins to create stable and hydrolysis-resistant amide bonds. For further information regarding such couplings, reference may be made to the work by Greg T Hermanson, "Bioconjugate Techniques", 2nd edition, Elsevier, 2008.

Two protocols have been followed in order to obtain the activated adhesion primer: a protocol for formation of activated esters in an organic medium and a protocol for formation of anhydrides in an aqueous medium. The subsequent coupling with the proteins is for its part always carried out in an aqueous medium.

1) Protocol for Activation in an Organic Medium of the Adhesion Primer.

i) Preparation of the Activation Solutions.

40 mg of dicyclohexylcarbodiimide (DCC) are dissolved in 17 ml of acetonitrile 22 mg of N-hydroxysuccinimide (NHS) are dissolved in 13 ml of acetonitrile.

ii) Condition for Activation of the PAA Surface:

A PAA strip grafted in its acid form is immersed in a solution containing 8 ml of acetonitrile, 1 ml of the dicyclohexylcarbodiimide (DCC) solution and 1 ml of the N-hydroxysuccinimide (NHS) solution. The PAA surface is left to react for 30 minutes.

iii) Condition for the Coupling with the Proteins:

A 1 mg/ml solution of protein (calmodulin) in DI water at a pH equal to 6 is prepared.

The PAA surface activated according to the conditions described above is immersed in 2 ml of the protein solution. The combination is placed in an incubator at 37° C. and under gentle stirring for 1 h.

Figure 13:
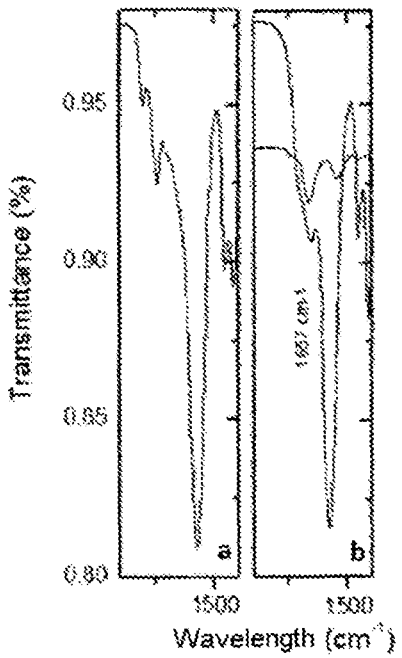

FIG. 13 illustrates the formation of activated esters at the surface of the PAA film (FIG. 13-*a*) and then the result of the coupling with the protein: appearance of a component bonded to the protein (FIG. 13-*b*). As the PAA film is not swollen by the acetonitrile, the NHS and DCC reactants have not penetrated into the PAA layer and only the surface carboxylic acid (COOH) groups are modified. 2) Protocol for activation in an aqueous medium of the adhesion primer:

i) Preparation of the Activation Solutions.

24 mg of 1-ethyl-3-(3-dimethylaminopropyl)carbodiimide hydrochloride (EDC) are dissolved in 10 ml of DI water.

16 mg of N-hydroxysuccinimide (NHS) are dissolved in 10 ml of DI water.

ii) Condition for Activation of the PAA Surface:

A grafted PAA strip in its acid form is immersed in a solution containing 8 ml of DI water at pH=4.5, 1 ml of the 1-ethyl-3-(3-dimethylaminopropyl)carbodiimide hydrochloride (EDC) solution and 1 ml of the N-hydroxysuccinimide (NHS) solution. The strip is left to react for 30 minutes.

iii) Condition for the Coupling of the Proteins:

A 1 mg/ml solution of protein (calmoduline) in DI water at a pH equal to 6 is prepared.

The PAA surface prepared according to the conditions described above is immersed in 2 ml of the protein solution. The assembly is placed in an incubator at 37° C. and under gentle stirring for 1 h.

Figure 14:
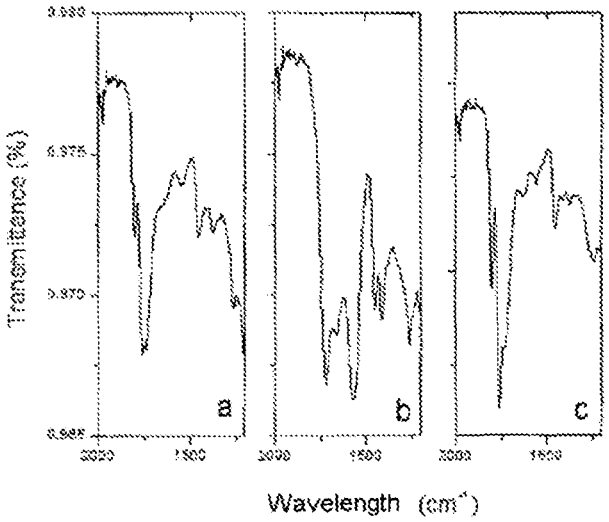
Figure 15:
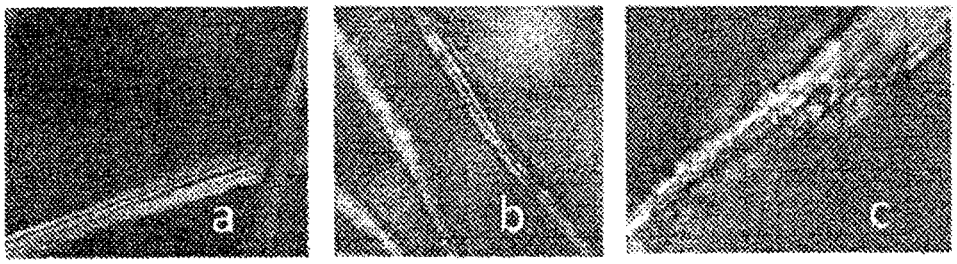
Figure 16:
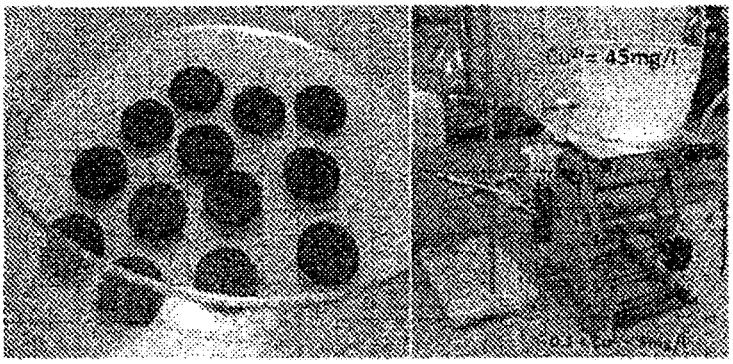

FIG. 14 illustrates the formation of the anhydrides by the chemical route in an aqueous medium in the presence of NHS and EDC (FIG. 14-*a*), and the result of the coupling with the protein (FIG. 14-*b*). It was confirmed beforehand that the anhydride functional groups persisted after immersion of the activated support in DI water at a pH equal to 6 for 15 minutes (FIG. 14-*c*). Thus, the disappearance of the anhydride functional groups after coupling with the protein is indeed the result of the reaction which took place between these functional groups and the protein.

Example 8: Thermal Immobilization of PAA on Carbon Felt for the Preparation of Filtering Elements for Industrial Heavy Metals (Cu, Zn, Ni, and the Like) in the Treatment of Liquid Effluents It is a matter of capturing salts of metal elements in solution on filters composed of carbon felt, which filters are coated with polyacrylic acid.

i) Manufacture of the Active Felts:

Disks of carbon felts (RVG 4000—0.7 $m^2/g$—d=0.088) with a diameter of 2.8 cm (340 mg) are subjected to an Ar-02 [90-10%] plasma treatment for 10 minutes in order to become wetting. This treatment limits the withdrawal of the liquid during the drying and makes it possible to obtain covering coatings with the whole of the fibers.

A PAA, Mn 130 000, solution with a concentration typically of 50 mg in 10 ml of ethanol is prepared by dissolution.

A solution of polyethyleneimine (PEI), of MW 25000, of 5 mg in 10 ml of DI water is prepared by dissolution.

A first impregnation is carried out with a 5 mg/10 ml aqueous polyethyleneimine (PEI) solution.

The felt is filled using a Pasteur pipette until it is visually detected that the impregnation is complete.

The felt is left to dry. The PEI (polymer exhibiting positive charges) coating reinforces the polyelectrolytic properties of the PAA (negatively charged) and results in a better subsequent encasing of the fibers by the PAA.

A second impregnation is carried out with a 50 mg/10 ml solution of PAA in ethanol until it is visually detected that the impregnation is complete.

The felt is left to dry.

A curing is carried out at 200° C. for 30 min.

The process makes possible an encasing which covers individual fibers of the carbon felt. Interference colors over the whole of the fibers, whether at the surface of the felt or inside the felt, are detected by optical microscopy.

After the heat treatment, the PAA is in the anhydride chemical form. In order to restore the carboxylic acid form which will capture the heavy metals, the hydrolysis of the anhydrides is carried out at pH=9 for 10 minutes.

The film thus manufactured is chemically stable on the fibers. For example, it withstands a basic aqueous solution of pH=10 which is nevertheless an excellent solvent for PAA).

The dry residue after drying is 16 mg and represents a mean thickness of PAA film encasing the fibers of 70 nm.

ii) Treatment on a Column of Solutions Containing Copper Salts.

13 felts thus prepared (which represents 211 mg of PAA immobilized on the 13 felts) are placed in a column (100 ml plastic syringe), and 2.4 l of a 45 mg/l solution of $Cu^{++}$ in faucet water are slowly filtered through the column.

With regard to the first liter filtered, the copper concentration of the filtrate recovered is 100 μg/L, which demonstrates the effectiveness of the capturing.

In the end, a fixing capacity (expressed as milligrams of copper per gram of felt) of 22 mg/g is observed. With respect to the weight of PAA, 22 mg of fixed copper are obtained per 50 mg of PAA, i.e. a value very close to the expected stoichiometry (two COO— functional groups per 1 $Cu^{++}$ ion). In other words, in the system according to the invention, 440 mg of Cu are captured per gram of PAA immobilized on the felt; this result is superior to the best resins in the bead form, where 50 to 200 mg/g are generally observed.

Example 9: Electroless Metallization of Woven Kevlar Fibers by Nickel and Copper A/ Coating and Immobilization of the Polyacrylic Acid (PAA) Coating A PAA ($M_n$ 130 000) solution with a concentration of 50 mg in 10 ml of ethanol is prepared by dissolution.

A fabric of woven Kevlar fibers of 9 $cm^2$ without specific cleaning.

For a complete metallization covering the whole of the fibers and each fiber individually, the PAA solution is applied by dipping-withdrawing (immersion-emersion) in order to obtain, after evaporation of the ethanol, a covering and homogeneous PAA film with a thickness of 50 to 70 nm. The PAA deposition is carried out then over all the fibers.

The fabric of Kevlar fibers coated with the PAA is then typically heated at 200° C. for 30 min in an ordinary oven at atmospheric pressure and without specific precautions.

For the metallization of the PAA layer, the Kevlar fabric is first of all immersed in an aqueous solution of pH=9 in order to rapidly hydrolyze the anhydrides, thus restoring the chemical form of the PAA. A rinsing operation with DI water is carried out.

B/ Electroless Nickel Metallization of PAA-Coated Kevlar Fabric

B1) Nickel Metallization Activation

Preparation of the activation solution. The solution can be prepared in advance.

Typically:

70 mg of palladium acetate ($Pd(CH_3CO_2)_2$), 50 ml of 0.5M HCl, 150 ml of distilled water (DI) and 1.4 g of NaCl. After complete dissolution, the pH is adjusted to between 5 and 6 with concentrated NaOH and HCl solutions.

B2) Electroless Nickel Metallization

The fabric of activated fibers is immersed in an electroless bath (that is to say, a nonelectrolytic bath) regulated at the temperature of 34° C.

The bath is typically a commercial Niposit™ PM 988 bath. Its pH is 9.4. The reducing agent is sodium hypophosphite ($NaH_2PO_2.H_2O$).

The tissue of activated fibers is left for ten minutes in order to have a complete and homogeneous metallization.

A rinsing operation with water and then a drying operation with the dry gas blower are sufficient. The thickness of the nickel film is typically 500 nm.

C/ Electroless Copper Metallization of PAA-Coated Kevlar Fabric

C1) Copper Metallization Activation

The PAA-coated Kevlar fabric is immersed in an ammonium cupric sulfate solution at pH=12 for 5 min. A rinsing operation with DI water is carried out before the reduction of the copper salts by 2.5 g/l $NaBH_4$ in 0.1M NaOH medium (pH=13). The reduction bath is regulated at 50° C. and the reduction is typically carried out for 5 to 10 min. The fabric is rinsed with DI water.

C2) Electroless Copper Metallization.

The electroless copper bath is a bath sold by Pegastech which metalizes at 2 μm per hour at 45° C. and pH=13.

A Kevlar fabric metalized with copper is obtained.

Example 10: Aeronautic-Type Carbon-Epoxy Composite Metallization

A/ Coating and Immobilization of the Polyacrylic Acid (PAA) Coating

A PAA ($M_n$ 130 000) solution with a concentration of 50 mg in 10 ml of ethanol is prepared by dissolution.

A sheet of carbon-epoxy composite of aeronautic type.

For a complete metallization covering the sheet of carbon-epoxy composite individually, the PAA solution is applied by dipping-withdrawal (immersion-emersion) in order to obtain, after evaporation of the ethanol, a covering and homogeneous PAA film with a thickness of 50 to 70 nm. The PAA deposition takes place then on the fraction of sheet immersed.

The sheet of carbon-epoxy composite coated with the PAA is then typically heated at 200° C. for 30 min in an ordinary oven at atmospheric pressure and without specific precautions.

For the metallization of the PAA layer, the sheet of carbon-epoxy composite is first of all immersed in an aqueous solution of pH=9 in order to rapidly hydrolyze the anhydrides, thus restoring the chemical form of the PAA. A rinsing operation with DI water is carried out.

B/ Electroless Nickel Metallization of the PAA-Coated Sheet of Carbon-Epoxy Composite B1) Nickel Metallization Activation Preparation of the activation solution. The solution can be prepared in advance.

Typically:

70 mg of palladium acetate ($Pd(CH_3CO_2)_2$), 50 ml of 0.5M HCl, 150 ml of distilled water (DI) and 1.4 g of NaCl. After complete dissolution, the pH is adjusted to between 5 and 6 with concentrated NaOH and HCl solutions. A rinsing operation with DI water is carried out.

B2) Electroless Nickel Metallization

The sheet of carbon-epoxy composite is immersed in an electroless bath (that is to say, a nonelectrolytic bath) regulated at the temperature of 34° C.

The bath is typically a commercial Niposit™ PM 988 bath. Its pH is 9.4. The reducing agent is sodium hypophosphite ($NaH_2PO_2.H_2O$).

The sheet of carbon-epoxy composite is left for 10 minutes in order to have a complete and homogeneous metallization.

Figure 17:
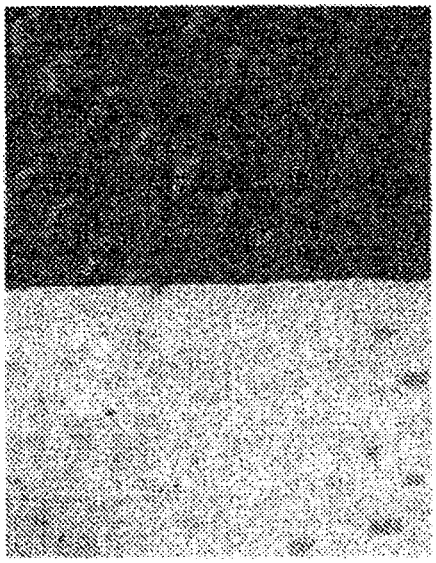
Figure 18:
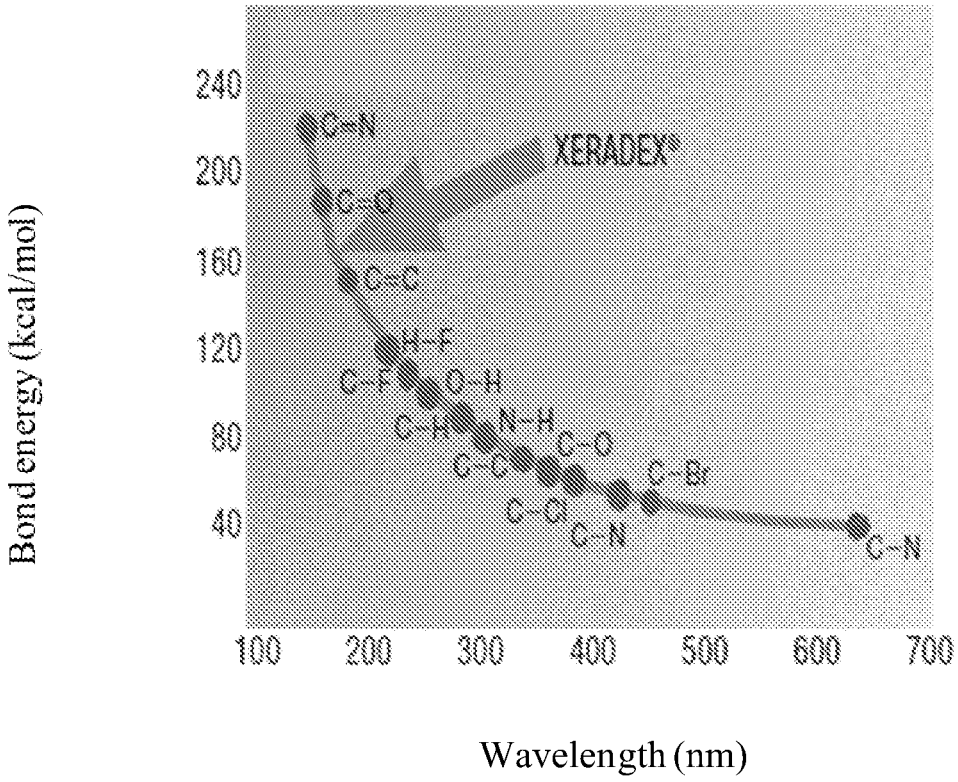

A rinsing operation with water and then a drying operation with the dry gas blower are sufficient. The thickness of the nickel film is typically 500 nm. In FIG. 17, it is observed that the lower part has been coated with grafted PAA and then metalized. The metallization has taken place only on the PAA-treated part.

An electrical measurement with a conventional measuring device typically observes a resistance of 30 ohms between the two electrodes 5 cm apart. The metal coating is thus conductive.

Example 11: Metallization of Polymer Substrates of ABS Type

A/ Coating and Immobilization of the Polyacrylic Acid (PAA) Coating

A PAA (typically $M_n$ 130 000) solution with a concentration typically of 50 mg in 10 ml of ethanol is prepared by dissolution.

The ABS surfaces are convex surfaces of mirror quality. They concern virgin components made of ABS used in particular in bathroom installations, such as, for example, bath plugs. The components are prepared with a simple degreasing with a surfactant and a rinsing operation with water and are then dried (typically by a dry nitrogen gas blower).

For a coating of full surface type, the PAA solution is typically applied by dipping-withdrawing (immersion-emersion) in order to obtain, after evaporation of the ethanol, a covering and homogeneous PAA film with a thickness typically of 50 to 70 nm.

The samples are typically subjected to irradiation by VUV irradiation for two minutes at a distance of 15 cm in an atmosphere purged of air by flushing with thy nitrogen for 10 minutes. The characteristics of the VUV lamp are: excimer lamp of the Osram brand, Xeradex model. Power of 140 W. Radiation 150 to 190 nm with a maximum at 172 nm. These characteristics remain the same for the following examples.

The immobilization of the thin PAA films is tested by a washing operation with ethanol and with water, which are very good solvents for PAA. The resistance of the films is observed over all the substrates. The tests of rinsing with alcohol or water before the irradiation very clearly show the complete removal of the PAA.

B/ Electroless Nickel Metallization of the ABS Substrate Coated with PAA

B1) Nickel Metallization Activation

Preparation of the activation solution. The solution can be prepared in advance.

Typically:

70 mg of palladium acetate ($Pd(CH_3CO_2)_2$), 50 ml of 0.5M HCl, 150 ml of distilled water (DI) and 1.4 g of NaCl. Wait until dissolution is complete.

Adjust the pH to between 5 and 6 with concentrated NaOH and HCl solutions. A rinsing operation with DI water is carried out.

B2) Electroless Nickel Metallization

The ABS substrate is immersed in an electroless bath (that is to say, a nonelectrolytic bath) regulated at the temperature of 34° C.

The bath is typically a commercial Niposit™ PM 988 bath. Its pH is 9.4. The reducing agent is sodium hypophosphite ($NaH_2PO_2.H_2O$).

The ABS substrate is left for 10 minutes in order to have a complete and homogeneous metallization.

A rinsing operation with water and then a drying operation with the dry gas blower are sufficient. The thickness of the nickel film is typically 500 nm.

Example 12: Metallization of Polymer Substrates of COP Type

A/ Coating and Immobilization of the Polyacrylic Acid (PAA) Coating

A PAA (typically $M_n$ 130 000) solution with a concentration typically of 50 mg in 10 ml of ethanol is prepared by dissolution.

The surfaces of COP (Cyclic Olefin Polymer) sold by Zeon (Zeonex®) are prepared with a simple degreasing operation with a surfactant and a rinsing operation with water and then dried (typically by a dry nitrogen gas blower).

For a coating of full surface type, the PAA solution is typically applied by dipping-withdrawing (immersion-emersion) in order to obtain, after evaporation of the ethanol, a covering and homogenous PAA film with a thickness typically of 50 to 70 nm.

The samples are typically subjected to irradiation by VUV radiation for 2 minutes at a distance of 4 cm in an atmosphere purged of air by flushing with dry nitrogen for 10 minutes.

The immobilization of the thin PAA films is tested by a washing operation with ethanol and with water, which are very good solvents for PAA. The resistance of the films is observed over all the substrates. The tests of rinsing with alcohol or water before irradiation very clearly show the complete removal of the PAA.

B/ Electroless Nickel Metallization of the COP Substrate Coated with the PAA

B1) Nickel Metallization Activation

Preparation of the activation solution. The solution can be prepared in advance.

Typically:

70 mg of palladium acetate ($Pd(CH_3CO_2)_2$), 50 ml of 0.5M HCl, 150 ml of distilled water (DI) and 1.4 g of NaCl. Wait until dissolution is complete. Adjust the pH to between 5 and 6 with concentrated NaOH and HCl solutions. A rinsing operation with DI water is carried out.

B2) Electroless Nickel Metallization

The COP substrate is immersed in an electroless bath (that is to say, a nonelectrolytic bath) regulated at the temperature of 34° C.

The bath is typically a commercial Niposit™ PM 988 bath. Its pH is 9.4. The reducing agent is sodium hypophosphite ($NaH_2PO_2.H_2O$).

The COP substrate is left for 10 minutes in order to have a complete and homogeneous metallization.

A rinsing operation with water and then a drying operation with the dry gas blower are sufficient. The thickness of the nickel film is typically 500 nm.

The invention claimed is:

1. A process for functionalizing a surface of a solid support with at least one layer of polymer of acrylic acid, said process comprising the stages of:

i) bringing said surface into contact with a solution consisting of:

at least one acrylic acid homopolymer; and a solvent;

ii) removing the solvent from the solution in contact with said surface; and iii) fixing the polymer to said surface by heat treatment at a temperature of between 150° C. and 300° C.;

the solid support being selected from the group consisting of metal oxides, papers, and carbon fibers.

2. The process as claimed in claim 1, in which the polymer is applied to the surface of the solid support by dipping, centrifuging, sprinkling, projection or transfer.

3. The process as claimed in claim 1, in which the process additionally comprises stages $ii_1$) and $ii_2$), subsequent to stage ii) of:

$ii_1$) rinsing the surface of the solid support obtained in stage ii) with water; and $ii_2$) drying said surface.

4. The process as claimed in claim 1, comprising a stage, subsequent to stage iii), of covalent grafting of at least one molecule to the polymer layer obtained.

5. The process as claimed in claim 4, in which the at least one molecule is a biological molecule or a resin.

6. The process as claimed in claim 4, in which the at least one molecule consists of two molecules as a two-component resin.

7. The process as claimed in claim 1, wherein the support comprises metal oxides.

8. The process as claimed in claim 1, wherein the support is selected from the group consisting of papers and carbon fibers.

9. The process as claimed in claim 1, wherein the support comprises papers.

* * * * *